US005447382A

United States Patent [19]

Yui et al.

[11] Patent Number: 5,447,382

[45] Date of Patent: Sep. 5, 1995

[54] APPARATUS AND METHOD FOR PRINTING

[75] Inventors: Yasuji Yui; Tomohiro Maekawa; Hitoshi Kamoda, all of Kanagawa; Shin Iima, Tokyo; Takashi Bunya, Kanagawa, all of Japan

[73] Assignee: Sony Corporation, Japan

[21] Appl. No.: 245,762

[22] Filed: May 18, 1994

[30] Foreign Application Priority Data

May 20, 1993 [JP] Japan ..... 5-118628

[51] Int. Cl.[6] ..... B41J 35/28

[52] U.S. Cl. ..... 400/207; 400/120.02; 400/224.2

[58] Field of Search ..... 400/120.01, 120.02, 400/207, 208, 224.2

[56] References Cited

U.S. PATENT DOCUMENTS

| | | | |
|---|---|---|---|
| 3,384,216 | 5/1968 | Thayer . | |
| 4,218,151 | 8/1980 | Kondur, Jr. . | |
| 4,496,955 | 1/1985 | Maeyama et al. . | |
| 4,898,484 | 2/1990 | Ayagi et al. | 400/208 |
| 4,910,533 | 3/1990 | Sasaki et al. . | |
| 4,917,513 | 4/1990 | Takanashi et al. | 400/208 |
| 4,924,242 | 5/1990 | Fukawa | 400/208 |
| 4,970,531 | 11/1990 | Shimizu et al. . | |
| 4,973,983 | 11/1990 | Yamamoto et al. | 400/208 |
| 5,005,998 | 4/1991 | Takanashi et al. . | |
| 5,035,325 | 7/1991 | Kitsuki | 400/208 |
| 5,037,218 | 8/1991 | Shimizu et al. . | |
| 5,061,099 | 10/1991 | Iwatani et al. . | |
| 5,079,565 | 1/1992 | Shimizu et al. . | |
| 5,087,137 | 2/1992 | Burnard et al. . | |
| 5,290,114 | 3/1994 | Asami et al. . | |

FOREIGN PATENT DOCUMENTS

| | | |
|---|---|---|
| 3932999 | 12/1990 | Germany . |
| 61-51380 | 3/1986 | Japan . |
| 63-254085 | 10/1988 | Japan . |
| 2-20368 | 1/1990 | Japan . |
| 2-95875 | 4/1990 | Japan . |
| 3292177 | 12/1991 | Japan . |

*Primary Examiner*—Edgar S. Burr
*Assistant Examiner*—John S. Hilten
*Attorney, Agent, or Firm*—Ronald P. Kananen

[57] ABSTRACT

A printer in which an ink ribbon is not wound when a ribbon code ring is read, a dedicated motor for rotating the ribbon code ring is not required, and it is possible to rotate the ribbon code ring with the same motor used for moving a printing head. When an information code of an ink ribbon is to be read, a print head is held in an initial position HO, and a pendulum gear, which can be rotated only when a cam is reversed, is brought into mesh with a ink ribbon code ring which rotates irrespective of a supply spool of a ribbon cassette. The information code on the ribbon code ring is detected by a sensor as the code ring is rotated. A locking system is provided for preventing accidental opening of a ribbon door of the printer during printing operations.

11 Claims, 28 Drawing Sheets

H0

H1, H2, H3, H3', H4

HO, PO

H2, PO

H2, P1

H3, P2

H4, P2

H2, P2

APPARATUS AND METHOD FOR PRINTING

BACKGROUND OF THE INVENTION

Field of the Invention

The present invention relates generally to a printer for printing a recorded image such as a video image or the like, as a hard copy in the form of a color photograph, and more particularly to an ink ribbon code reading mechanism for a color video printer of the sublimational thermal-transfer type.

Description of the Related Art

Conventional ribbon code reading mechanisms for an ink ribbon stored in a ribbon cassette in a color video printer include three general types of ribbon code reading mechanisms as follows:

(a) A ribbon code reading mechanism in which, while bringing the head of an ink ribbon from a ribbon cassette into an operative position, an information mark on a ribbon code ring mounted on the shaft of an ink ribbon supply spool in the ribbon cassette is detected by a sensor when the ink ribbon supply spool is rotated while the ink ribbon is being wound;

(b) A ribbon code reading mechanism in which a dedicated motor is used for reading a ribbon code ring, a pendulum gear is rotated by energization of the motor, and a ribbon code is read by a sensor; and (c) A ribbon code reading mechanism in which, when a print head is moved, a ribbon code ring is rotated by a gear held in ganged relation to the movement of the print head, and a ribbon code is read by a sensor. A ribbon code reading mechanism of this type is shown generally in U.S. Pat. No. 5,290,114.

With the ribbon code reading mechanism (a), the ink ribbon is required to be as long as the angular displacement of the ribbon code ring, and if the ribbon code ring is to be rotated to make several revolutions for increasing the reliability with which the ribbon code is read, then the ink ribbon is also required to be long commensurately with such several resolutions to be made by the ribbon code ring.

The ribbon code reading mechanism (b) requires a motor dedicated to rotate the ribbon code ring. Because a space for installing the motor is needed, it is difficult to reduce the size of the printer, and the cost of the printer is increased.

In the ribbon code reading mechanism (c), when the ribbon code ring is rotated, since the print head is lowered in ganged relation to the ribbon code ring, the ink ribbon is loosened or slackened. With the ink ribbon loosened, the ink ribbon cannot easily be removed from the printer paper. A process of removing the slack from the ink ribbon is time-consuming.

The present invention has been made to solve the above problems of the conventional ribbon code reading mechanisms. It is therefore an object of the present invention to provide a printer in which an ink ribbon is not wound when a ribbon code ring is read, a dedicated motor for rotating the ribbon code ring is not required, and it is possible to rotate the ribbon code ring with the same motor used for moving a print head.

Another problem with conventional video printers is in the ribbon door for inserting and ejecting a ribbon cassette from the printer. Conventional video printers include a cassette holder for holding the ribbon cassette in a predetermined position, and a ribbon door without a lock member for closing the cassette holder. In these devices, the ribbon door may be opened accidentally during printing. To avoid damage to the printer ribbon and other printer components, some conventional printers include a system to stop the printing operation automatically in response to an output of a switch for detecting opening of the ribbon door to avoid damage when the ribbon door is opened.

However, when the ribbon door of these conventional devices is opened accidentally during printing, the quality of the current printing will be reduced if the printing is stopped. On the other hand, damage to the printer components may occur if the printing operation is not stopped upon opening the ribbon door. Thus, it is a further object of the present invention to provide a printer which does not allow accidental opening of the ribbon door during printing operation.

SUMMARY OF THE INVENTION

To achieve the above object, there is provided in accordance with the present invention a printer having a ribbon code ring rotatably mounted on one ink ribbon takeup shaft of a ribbon cassette and a sensor for reading an information mark on the ribbon code ring, characterized in that the ribbon code ring is rotatable through a rotation transmitting means in ganged relation to rotation of a cam gear for moving a print head.

In the printer thus arranged according to the present invention, when the ribbon code ring is read, the print head is stopped in an initial position. By reversing the cam gear under this condition, the print head remains in the initial position. The rotation transmitting means which is rotated by the rotation of the cam gear is brought into mesh with the ribbon code ring. The information mark on the ribbon code ring thus rotated is detected by the sensor.

As described above, the printer according to the present invention has a ribbon code ring rotatably mounted on one ink ribbon takeup shaft of a ribbon cassette and a sensor for reading an information mark on the ribbon code ring, characterized in that the ribbon code ring is rotatable through a rotation transmitting means in ganged relation to rotation of a cam gear for moving a print head. Therefore, since the ribbon code ring is rotated by the motor and the cam gear which operate to move the print head, no dedicated motor is necessary for rotating the ribbon code ring, so that the space in the printer may be reduced and the cost of the printer may be lowered.

DETAILED DESCRIPTION OF PREFERRED EMBODIMENTS

The present invention as embodied in a color video printer of the sublimational thermal transfer type, for example, will be described below with reference to the accompanying drawings.

An overall construction of a video printer according to the embodiment will first be described below.

Figure 1:
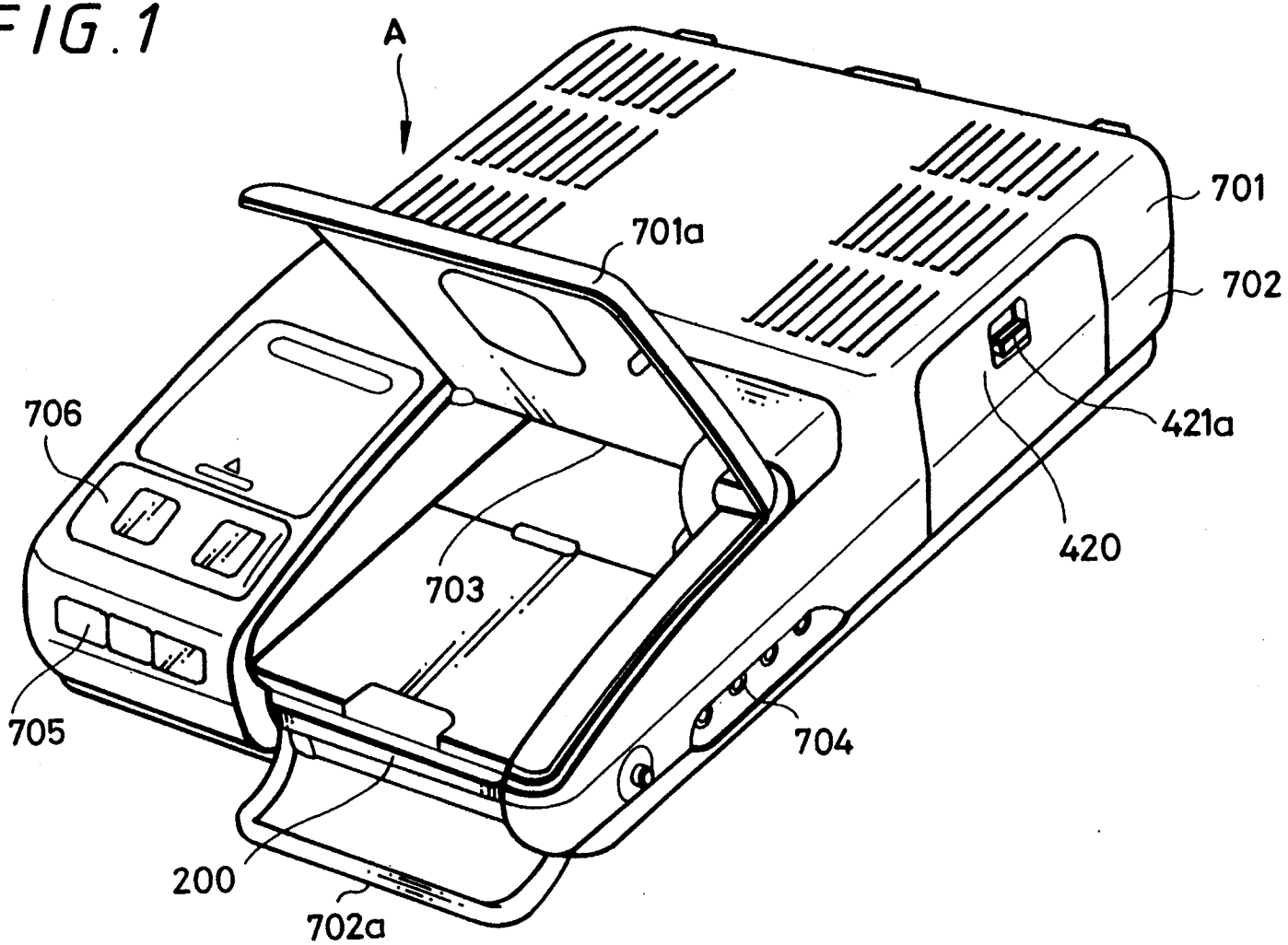
FIG. 1 is a perspective view of a printer according to the present invention.

FIG. 1 shows, in perspective, a video printer (hereinafter simply referred to as a "printer"), generally denoted at A. The printer A has a housing composed of upper and lower cases 701, 702 made of plastic. The printer A has an ink ribbon door 420 openably and closably disposed on a rear portion thereof for storing an ink ribbon cassette (hereinafter referred to as "ribbon cassette") in the printer A.

The printer A also has on a front portion a sheet feed tray 200, a print sheet discharge slot 703, video signal input terminals 704, a power supply switch 705, and various switches 706 for determining an image to be printed and indicating the number of prints to be produced.

The sheet feed tray 200 can be taken into and out of the printer A by opening a sheet door 702*a* of the lower case 702 and a sheet discharge cover 701*a* of the upper case 701.

FIGS. 2, 3, 4, and 5 are vertical cross-sectional views taken along different vertical planes across the printer A. The printer A includes a channel-shaped chassis 401 having an upper opening with a top plate 404 disposed therein and side surfaces with a bracket 100 and a rear bracket 301 mounted thereon. A ribbon cassette 1 is housed in a side opening 401*a* in the chassis 401. The sheet feed tray 200 is removably mounted in a front opening 401*b* in the chassis 401.

The sheet feed tray 200 has rectangular holes defined in a bottom thereof for insertion therein of a finger 201*a* of a sheet feed plate 201 and respective fingers 203*a* of a pair of laterally spaced pressers 203. The sheet feed plate 201 and the pressers 203 can be turned about the respective fingers 201*a*, 203*a* by a sheet feed arm 204 (see FIG. 4) that is angularly moved by a cam (described later on), for pressing an end of a print sheet 202 in the sheet feed tray 200 against a sheet feed roller 213. The sheet feed tray 200 is guided by rails (not shown) and installed in position in the printer A.

During sheet feeding operation, a lock finger 209 is turned by the cam, and engages in a hole 200*a* defined in the sheet feed tray 200 to prevent the sheet feed tray 200 from being pulled out.

The printer A generally comprises an ink ribbon mechanism actuatable by a DC motor as a drive source for winding and rewinding an ink ribbon in the ribbon cassette 1 to bring the head of the ink ribbon into an operative position or during printing operation, a print sheet feed/discharge mechanism actuatable by a stepping motor as a drive source for supplying a print sheet from the tray 200 into a print position and discharging a printed print sheet from the print sheet discharge slot 703, and a head mechanism actuatable by a DC motor as a drive source for causing a linear thermal head to print an image on a print sheet.

The ink ribbon mechanism, the print sheet feed/discharge mechanism, and the head mechanism will hereinafter be described in the order named.

Figure 6:
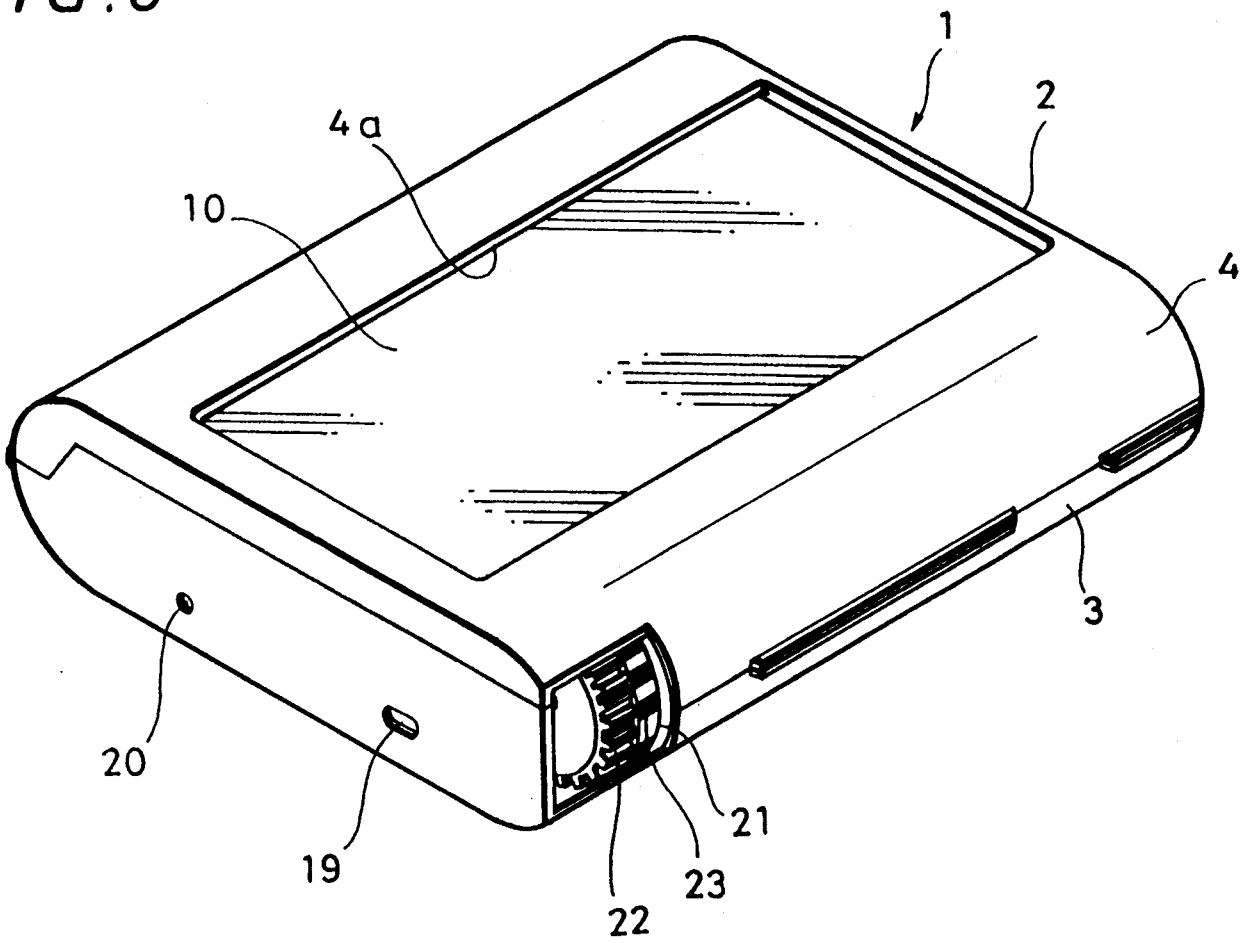
FIG. 6 is a perspective view of a ribbon cassette.
Figure 7:
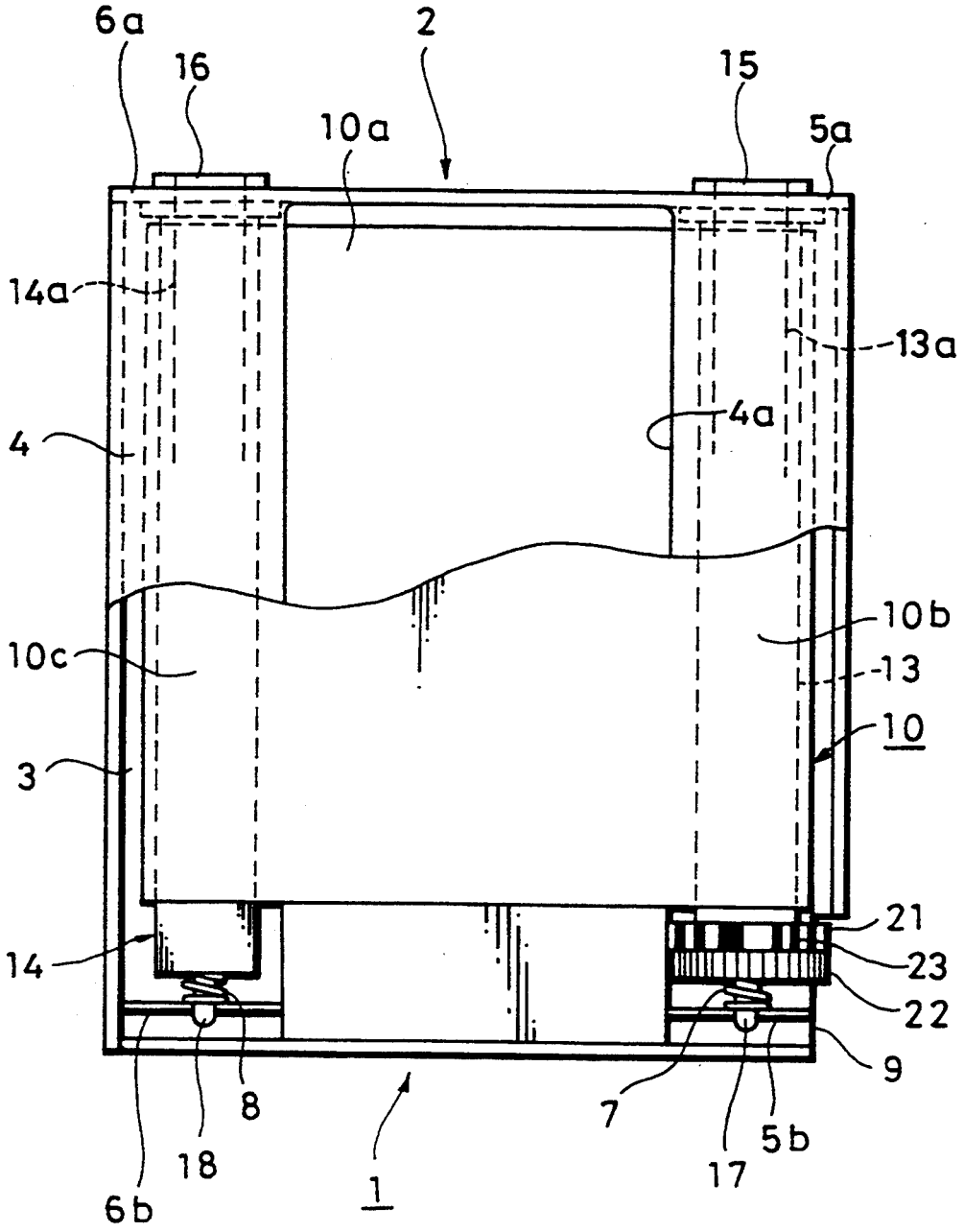
FIG. 7 is a plan view, partly broken away, of the ribbon cassette.
Figure 8:
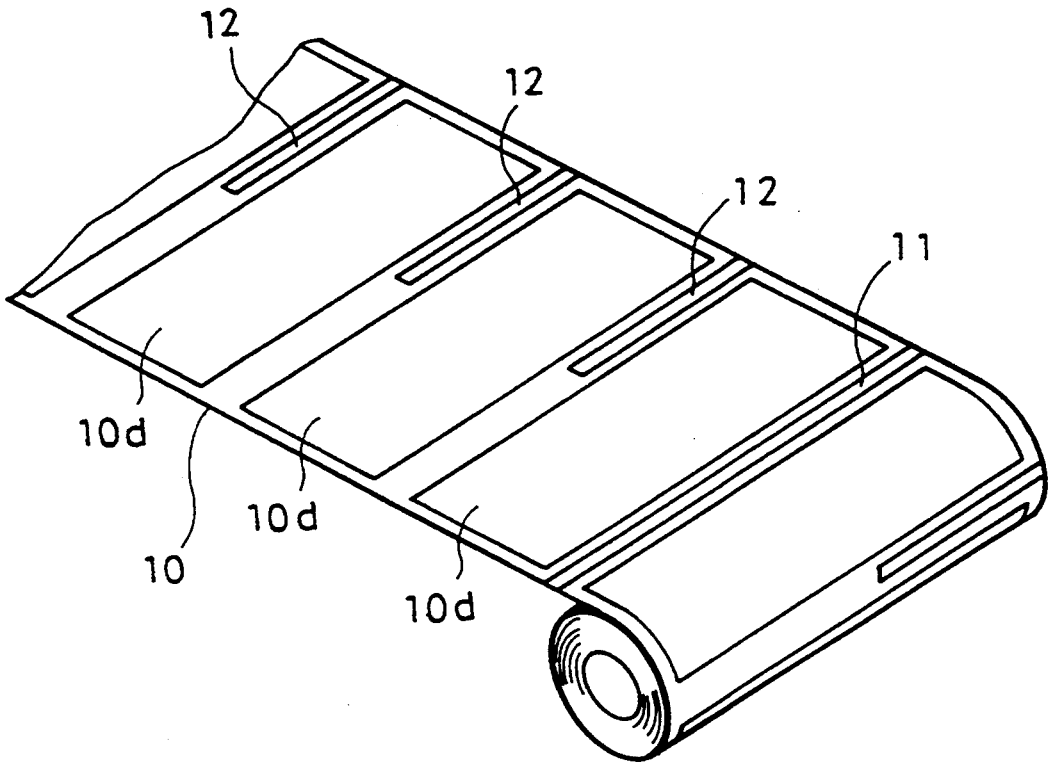
FIG. 8 is a perspective view of an ink ribbon.

FIGS. 6 through 8 show the ribbon cassette 1 in detail. The ribbon cassette 1 has a cassette casing 2 composed of lower and upper cases 3, 4 made of synthetic resin. The upper case 4 has a central rectangular opening 4*a* defined therein through which a usable ink ribbon portion 10*a* of an ink ribbon 10 is exposed. The lower and upper cases 3, 4 jointly provide a pair of bearings 5*a*, 5*b* by which there are rotatably supported an end 15 and a shaft end 17 of a supply spool 13 with an unused ink ribbon portion 10*b* wound thereon, and another pair of bearings 6*a*, 6*b* by which there are rotatably supported an end 16 and a shaft end 18 of a takeup spool 14 for winding a used ink ribbon portion 10c thereon.

The supply spool 13 and the takeup spool 14 are normally axially urged toward the bearings 5*a*, 6*a*, respectively, by respective compression coil springs 7, 8. A code ring 21 is rotatably mounted coaxially on the supply spool 13. The code ring 21 has an information code 23 on its outer circumferential surface which represents information with respect to the type, sensitivity, and count of the ink ribbon 10. Even when the supply spool 13 is held at rest, the code ring 21 can be rotated by a gear 22 which can be driven from outside of the ribbon cassette 1.

When not subjected to forces from outside of the ribbon cassette 1, the code ring 21 can rotate with the supply spool 13 due to frictional forces developed between the supply spool 13 and the code ring 21. The ink ribbon 10 is printed with a header mark 11 that extends fully transversely thereacross, the header mark 11 indicating the position where the ink ribbon 10 is to start writing information upon printing. If the ink ribbon 10 is a multi-color ink ribbon, then it is printed with patch marks 12 that extend transversely a half of the width of the ink ribbon 10, the patch marks 12 indicating the positions where ink ribbon portions 10*d* of respective colors are to start writing information upon printing. The cassette casing 2 has holes 19, 20 in which cassette pins 402, 403 (see FIG. 2) engage to position the cassette casing 2 when the ribbon cassette 1 is inserted in the printer.

Figure 9:
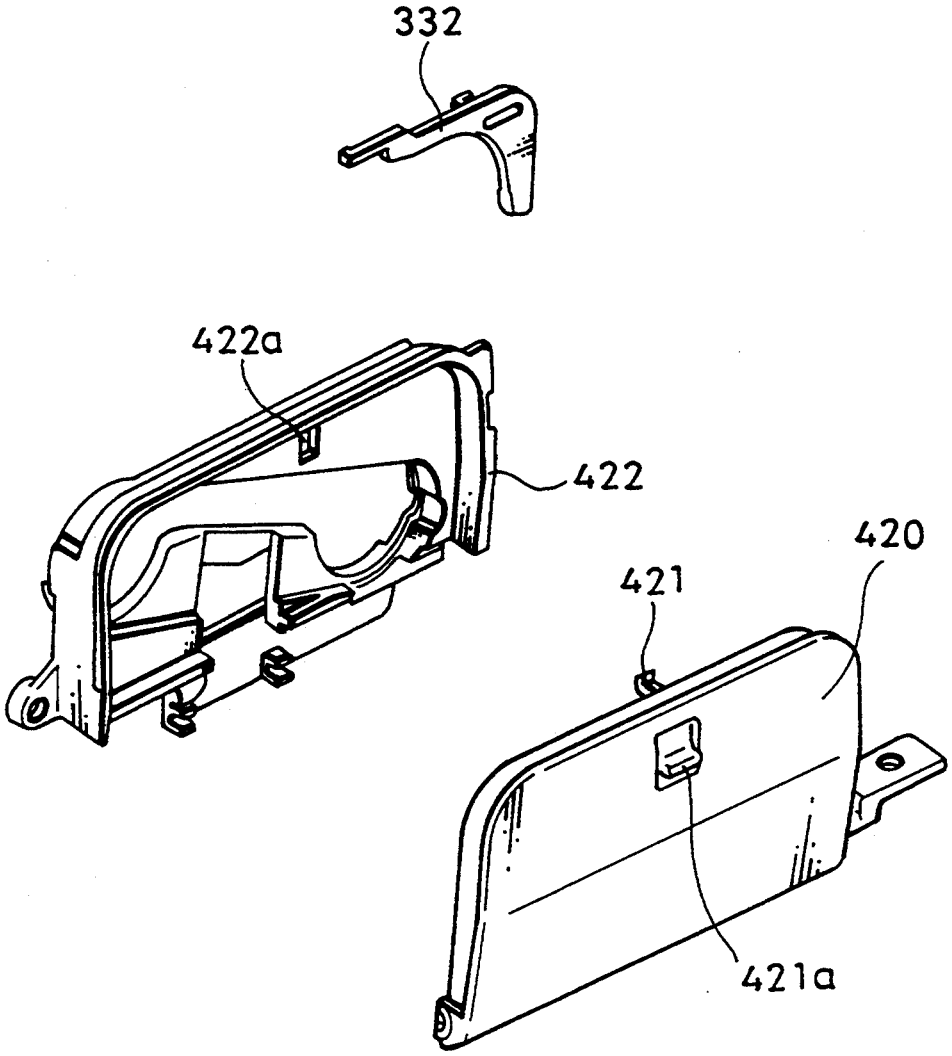
FIG. 9 is a perspective view of an ink ribbon door and a ribbon door holder.
Figure 10:
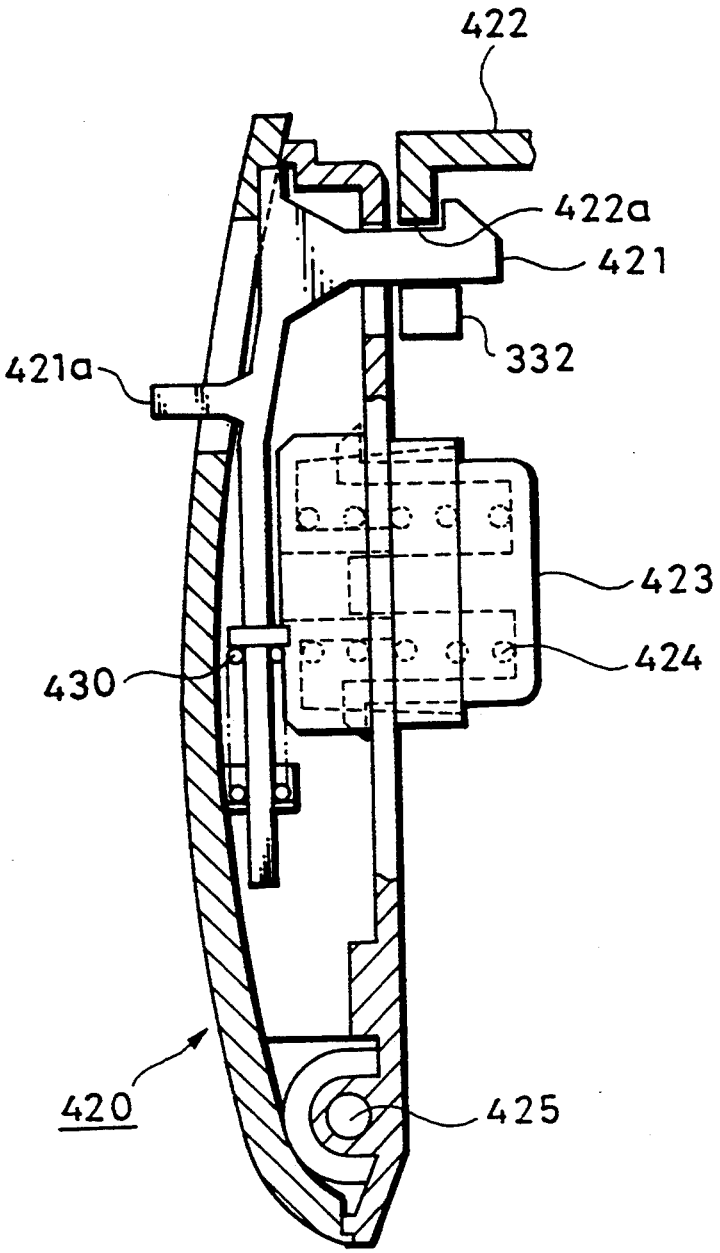
FIG. 10 is a cross-sectional view of the ink ribbon door.

Ribbon door 420:

A section where the ribbon cassette 1 can be inserted into and removed from the printer will be described below with reference to FIGS. 9 and 10. An inlet guide 426 (see FIG. 4) is mounted in the opening 401*a*, and the ink ribbon door 420 is angularly movably supported on the inlet guide 426 by a shaft 425. The ink ribbon door 420 has a lock finger 421 which can engage in a hole 422*a* defined in a ribbon door holder 422 to keep the ink ribbon door 420 closed. The lock finger 421 is normally biased by a spring 430 so as not to be unlocked from the hole 422*a*. The lock finger 421 has a knob 421*a* projecting outwardly of the ink ribbon door 410 and which can be pressed downwardly to disengage the lock finger 421 from the hole 422*a* for allowing the ink ribbon door 420 to be opened.

Figure 4:
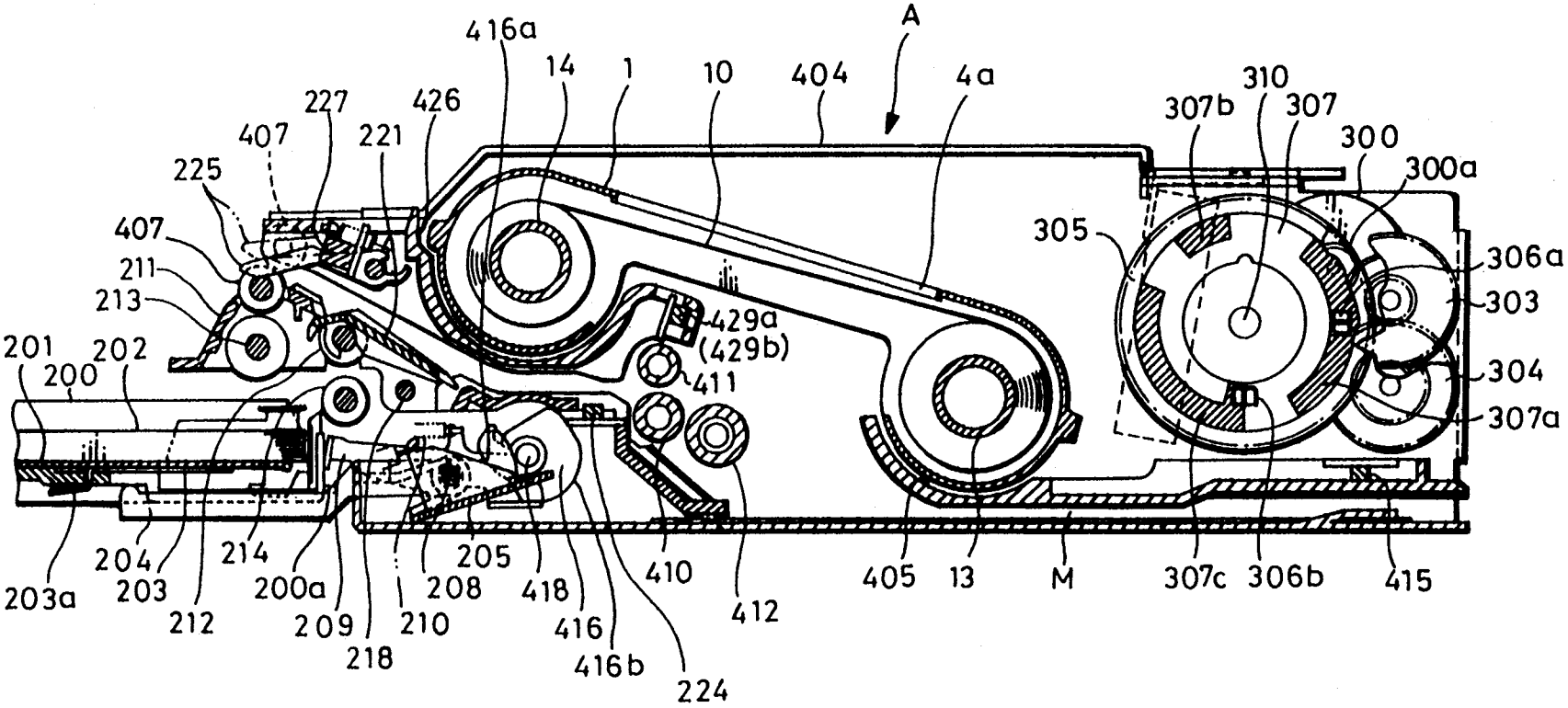
FIG. 4 is a cross-sectional view of the printer, taken along a plane across a gear 305.

The ribbon cassette 1 can be guided by the inlet guide 426 until it is stored in a cassette storage chamber 405 (see FIG. 4). When the ink ribbon door 420 is closed after the ribbon cassette 1 has been stored in the cassette storage chamber 405, the ink ribbon door 420 is locked by the lock finger 421, and the stored ribbon cassette 1 is urged inwardly into the printer by a ribbon presser 423 that is biased by a spring 424 projecting behind the ink ribbon door 420.

Lock lever for ribbon door 420:

In order to prevent the ribbon cassette 1 from being removed during printing operation, a lock lever 332 attached to the ink ribbon door 420 is positioned underneath the lock finger 421 by a cam (described later on) to limit downward movement of the lock finger 421. During printing operation, therefore, the operator cannot depress the knob 421*a* of the lock finger 421, and hence unlock the lock finger 421. Consequently, the ink ribbon door 420 cannot be opened, making it impossible to remove the ribbon cassette 1 during the printing operation.

Operation of the ink ribbon mechanism with the DC motor as the drive source thereof will be described below.

Parts that are driven by rotation of a motor 101 (see FIG. 5) will first be described below. The motor 101 is rotatable in normal and reverse directions, and a pendulum gear 107 operates to switch between different rotation transmitting paths when the motor 101 rotates in the normal or reverse direction. Specifically, when the motor 101 rotates in one direction, the rotation is transmitted through a takeup reel base 111 to the takeup spool 14 of the ribbon cassette 1, and when the motor 101 rotates in the opposite direction, the rotation is transmitted to a cam of a print sheet feed mechanism.

Transmission of rotation to takeup spool 14:

The rotation of the motor 101 is transmitted through a worm base 103 press-fitted over the shaft of the motor 101 to a worm 104 and then to double gears 105, 106 by which the speed of rotation is reduced. Frictional forces are developed as by a spring (not shown) between the pendulum gear 107 and a pendulum gear arm 108. When the double gear 106 rotates clockwise in FIG. 5, the pendulum gear arm 108 also rotates clockwise, bringing the pendulum gear 107 into mesh with a gear 109 which transmits the rotation to a gear 110 (see FIG. 11). The gear 110 is part of the takeup reel base 111 which has a torque limiting function.

Figure 11:
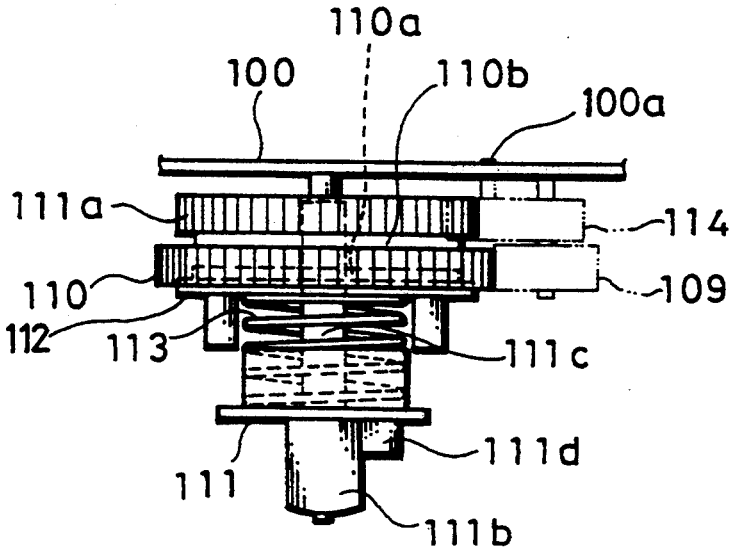
FIG. 11 is a detailed view of the takeup reel base.

The takeup reel base 111 is shown in FIG. 11. Felt pieces 110*a*, 110*b* are applied to respective opposite surfaces of the gear 110, which is rotatable with a pressure plate 112 about a hollow shaft 111*c*. A gear 111*a* and an engaging boss 111*b*, which serves to transfer torques to the takeup spool 14 of the ribbon cassette 1, are press-fitted over the shaft 111*c*, so that the gear 111*a*, the engaging boss 111*b*, and the shaft 111*c* are rotatable in unison with each other. The pressure plate 112 is rotatable in the same direction as the engaging boss 111*b* by engagement between concave and convex portions of the pressure plate 112 and the engaging boss 111*b*.

A compression coil spring 113 is disposed between the engaging boss 111*b* and the pressure plate 112 for normally applying forces tending to press the felt piece 110*a* and the pressure plate 112 against each other and also to press the felt piece 110*b* and the gear 111*a* against each other, developing frictional forces. When the gear 110 is rotated, a torque produced due to the frictional forces is transmitted to the engaging boss 111*b*. When a torque greater than the torque produced due to the frictional forces is generated, since the felt pieces 110*a*, 110*b* slip against the pressure plate 112 and the gear 111*a*, respectively, such a torque cannot be transmitted to the engaging boss 111*b*.

The engaging boss 111*b* is fitted in an engaging sleeve 14*a* of the takeup spool 14. When the takeup spool 14 is angularly positioned to allow a tooth 111*d* of the engaging boss 111*b* to engage the engaging sleeve 14*a*, the rotation can be transmitted to the takeup spool 14.

Figure 12:
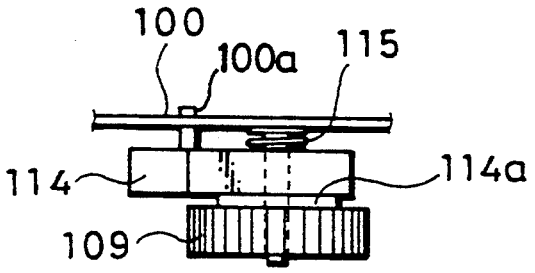
FIG. 12 is a detailed view of a gear 109.

Reverse prevention finger of the takeup reel base 111:

A finger 114 is mounted on the gear 109 for rotation in the same plane as the gear 111*a*. As shown in FIG. 12, a felt piece 114*a* is applied to the finger 114 and held against the gear 109. Frictional forces are developed between the felt piece 114*a* and the gear 109 by a compression coil spring 115 for rotating the finger 114 in the same direction as the gear 109. When the double gear 106 rotates clockwise, the gear 109 also rotates clockwise through the pendulum gear 107, and so does the finger 114. The finger 114 is prevented from unduly rotating by a hole 100*a* defined in the bracket 100. The function of the finger 114 will be described later on.

Transmission of rotation for movement to a sheet position:

When the double gear 106 rotates counterclockwise, the pendulum gear arm 108 rotates in the same direction as the double gear 105 to bring the pendulum gear 107 into mesh with a gear 116.

Reverse rotation preventing finger:

If the takeup spool 14 is reversed, thus loosening the ink ribbon, due to vibrations of the printer or electrostatic charges in the printer, then the takeup reel base 111 is also reversed and the gear 109 tends to rotate counterclockwise. Since the finger 114 is also rotated in the same direction as the gear 109, the finger 114 engages the gear 111*a* of the takeup reel base 111, thereby preventing the takeup reel base 111 from being rotated and hence preventing the ink ribbon from being loosened. (As long as the pendulum gear 107 is in mesh with the gear 109, the reverse rotation of the takeup reel base 111 is transmitted to the gears, tending to rotate the worm 104. However, since the worm 104 is a single worm, it is not rotated by the rotation of the double gear 105. Therefore, the takeup reel base 111 is not reversed, and the ink ribbon is not loosened.)

Figure 13A:
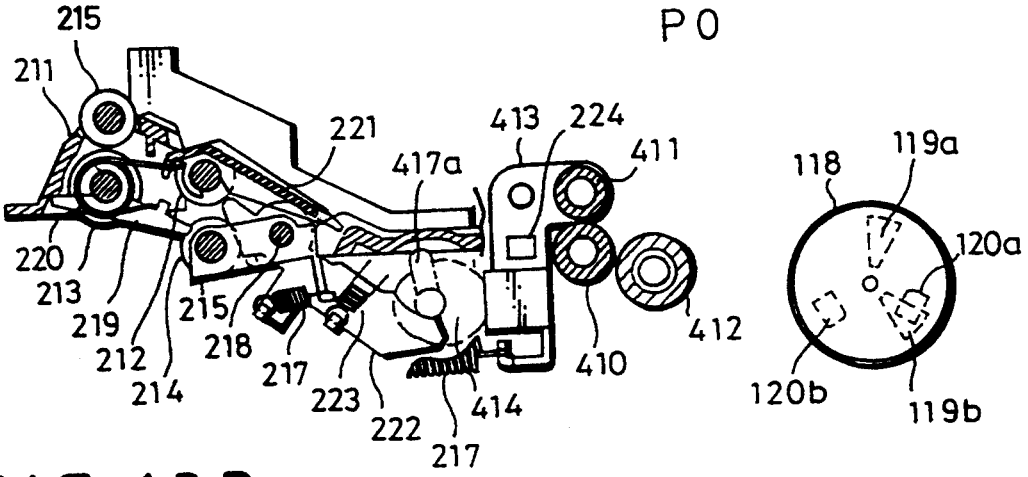
FIGS. 13A, 13B and 13C are diagrams showing the relationship between sensors and sheet positions in respective operation phases.
Figure 13B:
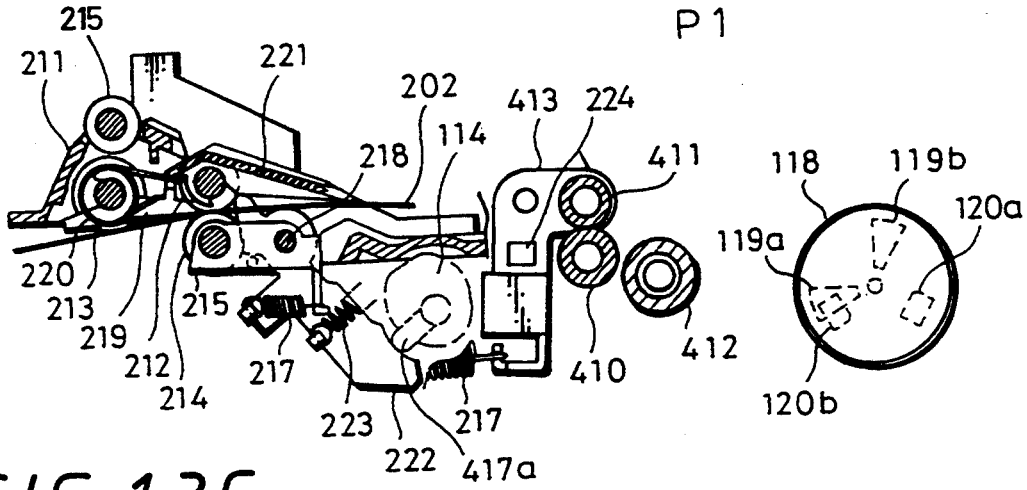
Figure 13C:
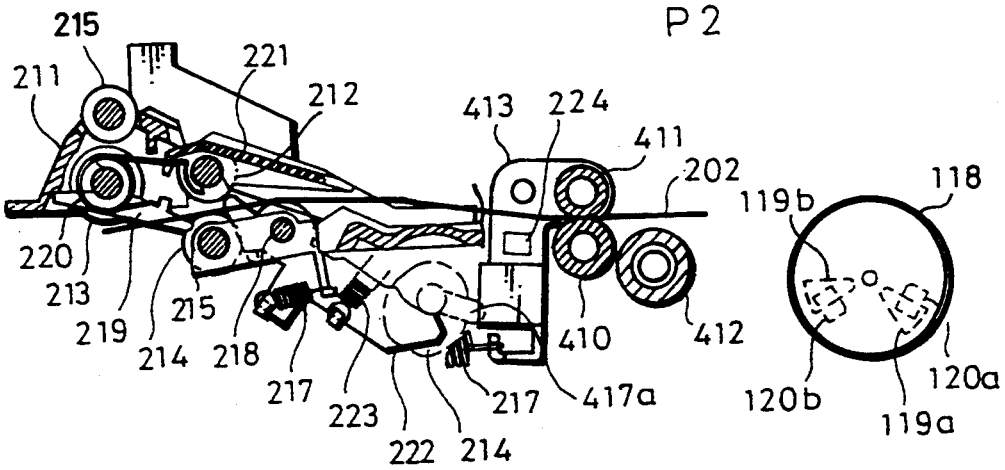

Movement to the sheet position (continued):

The rotation of the gear 116 is transmitted through a gear 117 to a gear 118. The gear 118 has a reflecting seal 119 attached thereto and its angular displacement is monitored by two optical sensors 120*a*, 120*b* that operate in association with the reflecting seal 119. The relationship between the gear 118 and the optical sensors 120*a*, 120*b* is illustrated in FIGS. 13A, 13B, and 13C. The reflecting seal 119 is made of a sheet of aluminum or the like whose surface has a high optical reflectance, and is printed with two black areas 119*a*, 119*b* of a lower optical reflectance. The optical sensors 120*a*, 120*b* detect the black areas 119*a*, 119*b* as dark areas, and the aluminum surface as a bright area.

The gear 118 is rotated only counterclockwise owing to the function of the pendulum gear 107. The rotation of the gear 118 is stopped when the optical sensor 120*a* detects a dark area and the optical sensor 120*b* detects a bright area. This stopped position of the gear 118 is referred to as a sheet position P0 (see FIG. 13A). Then, the gear 118 is rotated 120 degrees, and the rotation of the gear 118 is stopped when the optical sensor 120*a* detects a bright area and the optical sensor 120*b* detects a dark area. This stopped position of the gear 118 is referred to as a sheet position P1 (see FIG. 13B). Then, the gear 118 is further rotated 120 degrees, and the rotation of the gear 118 is stopped when the optical sensor 120*a* detects a dark area and the optical sensor 120*b* detects a dark area. This stopped position of the gear 118 is referred to as a sheet position P2 (see FIG. 13C). Further rotation of the gear 118 through 120, allows the optical sensors 120*a*, 120*b* to detect the sheet position P0. Therefore, the gear 118 can be angularly circulated through the sheet positions, i.e., from P0 to P1 to P2 to P0, and so forth, and can be moved to and stopped in any desired positions.

Figure 2:
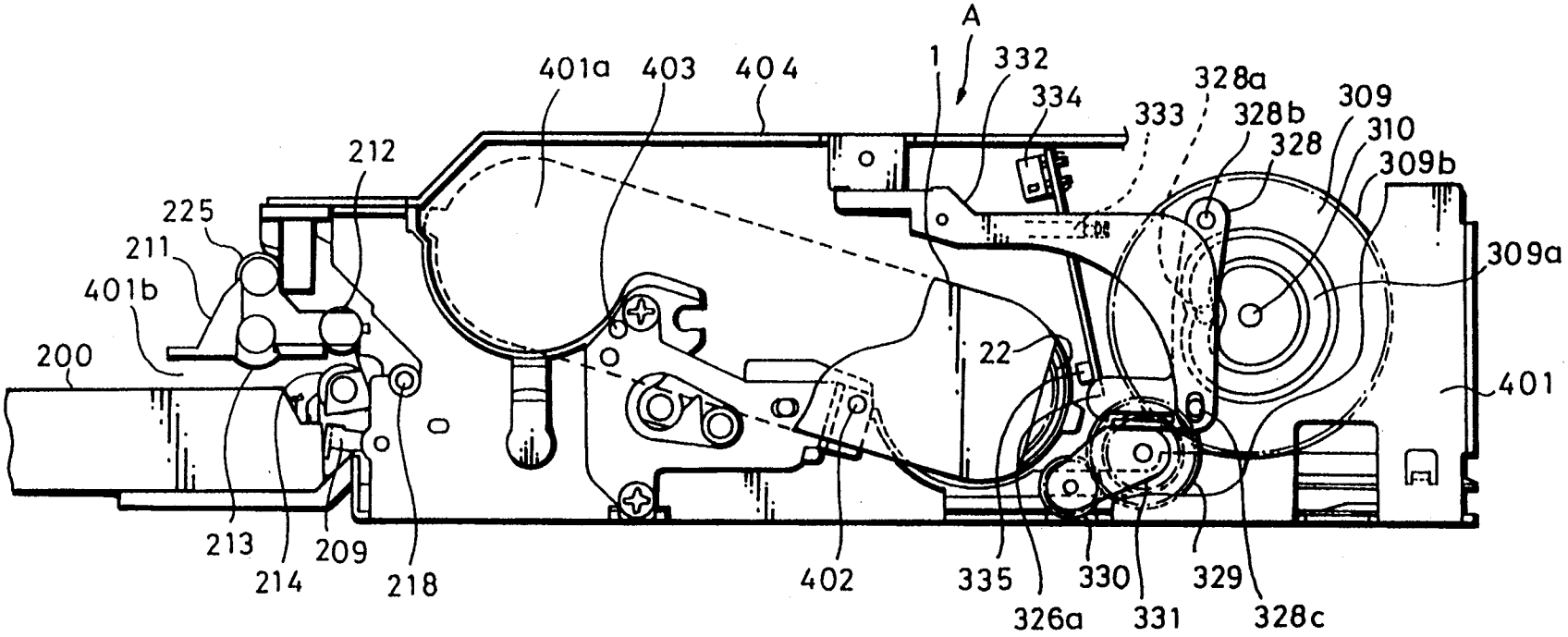
FIG. 2 is a side elevational view, partly broken away, of the printer.
Figure 14:
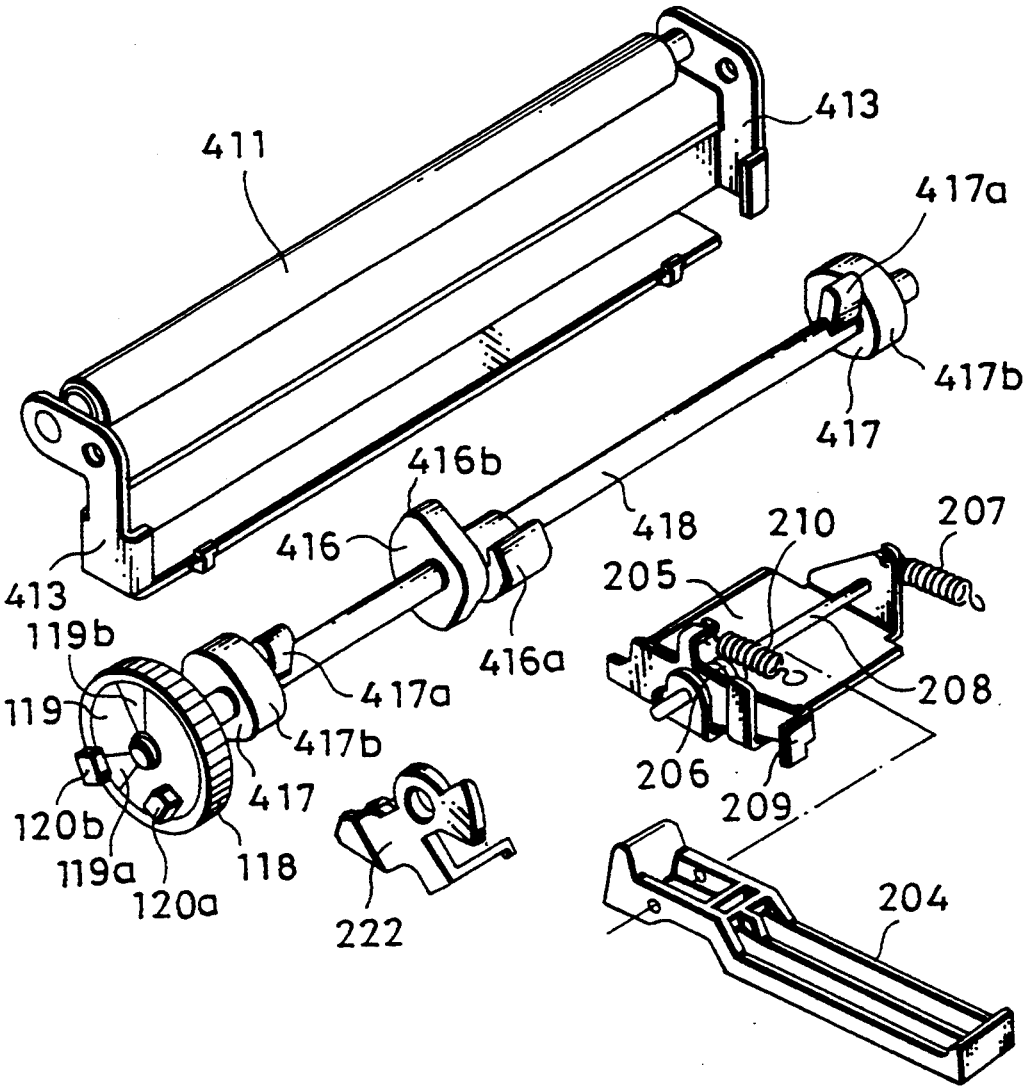
FIG. 14 is an exploded perspective view of a sheet feed cam, release cams, and companion parts.

Movement of cams of sheet positions and companion parts:

As shown in FIG. 14, a sheet feed cam 416 and a pair of release cams 417 are mounted on a shaft 418 which is rotatably supported on the chassis 401 (see FIG. 2). The gear 118 is mounted on an end of the chassis 418 for rotating the sheet feed cam 416 and the release cams 417. The sheet feed cam 416 has a cam surface 416*a* for angularly moving a pressing plate 205 and a cam surface 416*b* for angularly moving the lock finger 209.

Operation of the sheet feed cam 416:

As shown in FIG. 14, the pressing plate 205 is angularly movably mounted on a shaft 208 that is supported on a sheet feed arm 204 and the lock finger 209. The pressing plate 205 is normally urged by a spring 207 to move toward the sheet feed cam 416, and the lock finger 209 is normally urged by a spring 210 to move toward the sheet feed cam 416. The sheet feed arm 204 is pressed against the pressing plate 205 by a torsion coil spring 206 which limits their relative position. When the pressing plate 205 is angularly moved by the cam surface 416*a* of the sheet feed cam 416, the sheet feed arm 204 is also angularly moved therewith for thereby lifting the sheet feed plate 201 (see FIG. 4) to bring a print sheet 202 in the sheet feed tray 200 into contact with the sheet feed roller 213.

Upon continued angular movement of the pressing plate 205, the movement of the sheet feed arm 204 is limited by the sheet feed plate 201 which has been rendered angularly immovable by contact with the sheet feed roller 213. The pressing plate 205 and the sheet feed arm 204 are now angularly moved relatively to each other, causing the torsion coil spring 206 to flex resiliently and store energy. Under the spring force of the torsion coil spring 206, the sheet feed arm 204 applies a pressure to the sheet feed plate 201 for thereby pressing the print sheet 202 against the sheet feed roller 213.

The lock finger 209 is angularly moved by engagement with the cam surface 416*b* of the sheet feed cam 416. When the lock finger 209 is released from the cam surface 416*b*, the lock finger 209 engages in the hole 200*a* defined in the sheet feed tray 200 to prevent the sheet feed tray 200 from being pulled out.

Operation of the release cams 417:

Pinch roller arms 413 which are angularly movably supported the chassis 401 jointly support a pinch roller 411 rotatably thereon. The pinch roller 411 is normally urged in a direction to be pressed against a capstan 410 (see FIG. 3) under the bias of a spring 414. The release cams 417 operate to turn the pinch roller arms 413 in a direction to release the pinch roller 411 out of pressed contact with the capstan 410.

A release lever 222 is angularly movably supported on a shaft 218 (see FIG. 3) and is normally urged to move toward the release cam 417. The release lever 222 is angularly moved by the release cam 417 to cause a spring 217 to turn a turn plate 215 on which a separating roller 214 is rotatably supported, for thereby pressing the separating roller 214 against a sheet feed roller 212 and pushing open a shutter 221 (see FIG. 4) which is angularly movably mounted on the shaft of the sheet feed roller 212 and normally remains closed due to the biasing of a spring 220.

The spring 220 also biases a presser lever 219 angularly movably mounted on the sheet feed roller 213. The presser lever 219 has its standby position determined by a guide 211. A process of driving the sheet feed roller 212, the sheet feed roller 213, and the separating roller 214 will be described later in detail.

Operation of the stepping motor for actuating the print sheet feed/discharge mechanism will be described below.

A stepping motor 102 (see FIG. 5) is rotatable in normal and reverse directions through an angle which is a multiple of a step angle inherent in the stepping motor 102 under the control of a control circuit. The stepping motor 102 cooperates with the sheet feed cam 416 and the release cams 417 in feeding the print sheet 202, and also with a link 149 (described later) in rotating a supply reel base 146.

Sheet feed system:

Rotation of a pinion 121 that is press-fitted over the shaft of the stepping motor 102 is reduced in speed by a double gear 122 and transmitted to a gear pulley 123. A pendulum gear 124 is coupled to the gear pulley 123 through a pendulum arm 125. operation of the pendulum gear 124 will be described later on. The rotation of the gear pulley 123 is transmitted to a gear pulley 127 through a belt 126. The gear pulley 127 rotates the capstan 410 for feeding a print sheet. The capstan 410 comprises a roller rotatably supported on the chassis 401 by bearings (not shown) and having a surface processed to provide a large coefficient of friction with a print sheet.

Figure 15:
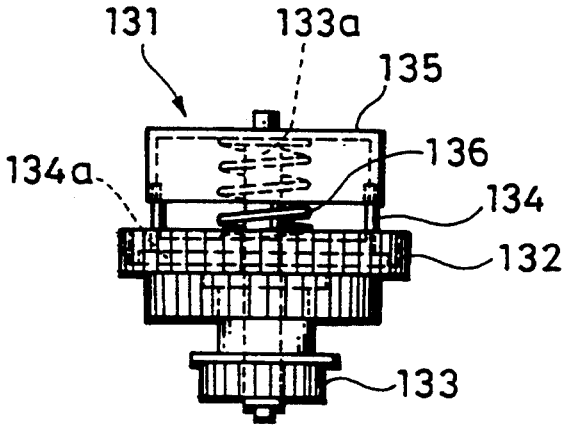
FIG. 15 is a view of a double gear 132.

The rotation of the gear pulley 127 is transmitted through gears 129, 130 to a double gear 132. The double gear 132 is part of a sheet feed limiter 131 having a torque limiting mechanism as shown in FIG. 15. In FIG. 15, the double gear 132 and a pressure plate 134 to which a felt piece 134*a* is applied are mounted on a hollow shaft 133*a* of a gear 133. A presser plate 135 is fitted over the shaft 133*a* for rotation in unison with the gear 133. The presser plate 135 and the pressure plate 134 are rotatable in the same direction by engagement between concave and convex portions thereof.

A compression coil spring 136 is disposed between the pressure plate 134 and the presser plate 135 for pressing the double gear 132 and the felt piece 134*a* against each other to develop frictional forces therebetween. When the double gear 132 rotates, it transmits a torque produced due to frictional forces to the gear 133. When a torque greater than the torque produced due to frictional forces is generated, since the double gear 132 slips against the felt piece 134*a*, such a torque cannot be transmitted to the gear 133.

Figure 5:
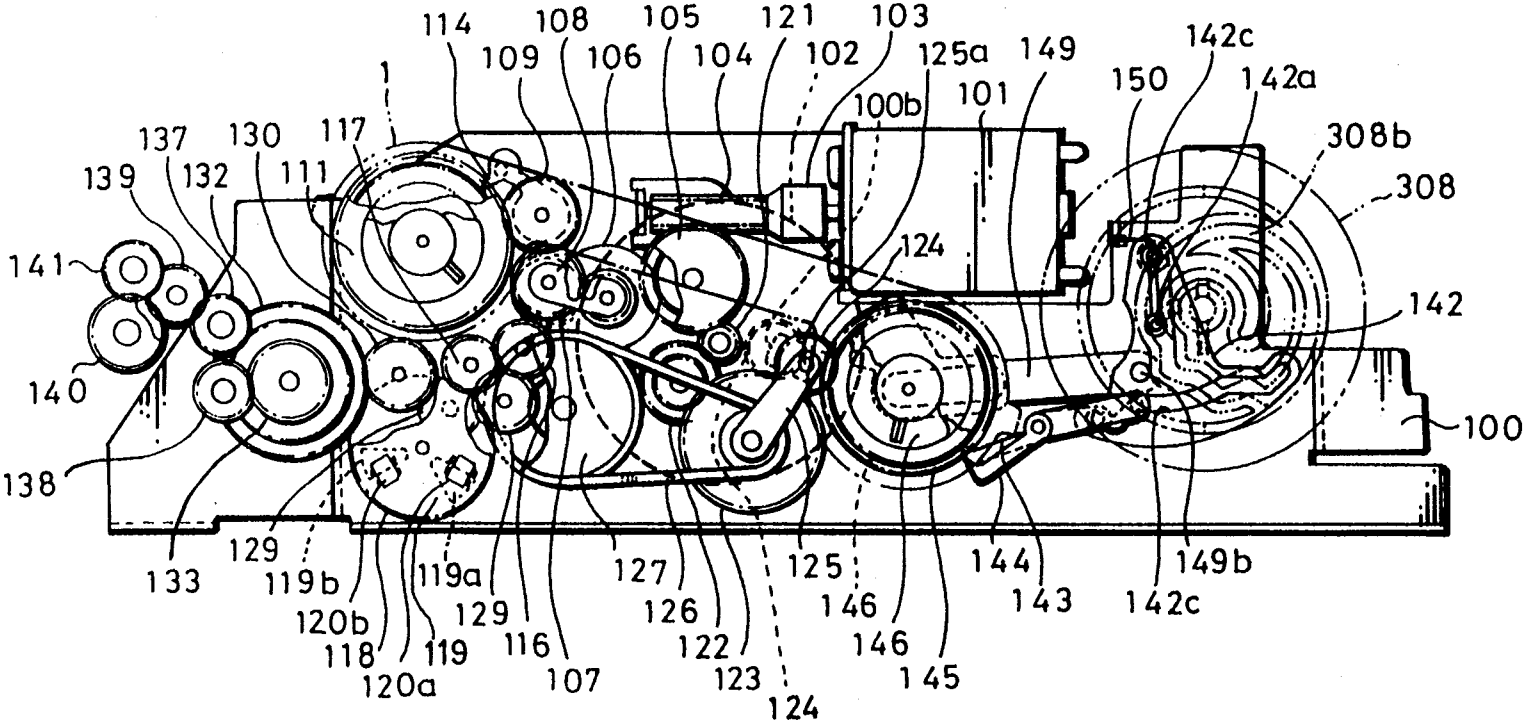
FIG. 5 is a side elevational view of a transmission mechanism system for a takeup reel base, a supply reel base, and a change arm.

As shown in FIG. 5, the rotation of the double gear 132 is transmitted to a gear 137, a gear 139, a double gear 140, and a gear 141. The rotation of the gear 133 is transmitted to a gear 138. The rotation of the gear 137 is transmitted to the sheet feed roller 212. The rotation of the gear 138 is transmitted to the separating gear 214. The rotation of the double gear 140 is transmitted to the sheet feed roller 213. The rotation of the gear 141 is transmitted to a sheet discharge roller 225.

The sheet feed roller 212, the sheet feed roller 213, and the sheet discharge roller 225 are rotatably supported by the guide 211 by bearings. The separating roller 214 is rotatably supported on the turn plate 215 by bearings.

Rewinding of the ink ribbon:

Operation of the pendulum gear 124, which is a central component of the printer, will be described below with reference to FIGS. 24A through 24D.

Frictional forces are generated between the pendulum gear 124 and the pendulum arm 125 by a spring or the like (not shown). While the pendulum arm 125 rotates in the same direction as the double gear 122, the pendulum arm 125 rotates in a limited angular range defined by a hole 100*b* defined in the bracket 100*a* in which a shaft 125*a* of the pendulum arm 125 is movable. When the double gear 122 rotates clockwise, the pendulum arm 125 rotates counterclockwise until its rotation is limited by an end of the hole 100*b* whereupon the pendulum gear 124 rotates idly. When the double gear 122 rotates counterclockwise, the pendulum arm 125 rotates clockwise to cause the pendulum gear 124 to mesh with a gear 145 of the supply reel base 146.

Figure 16:
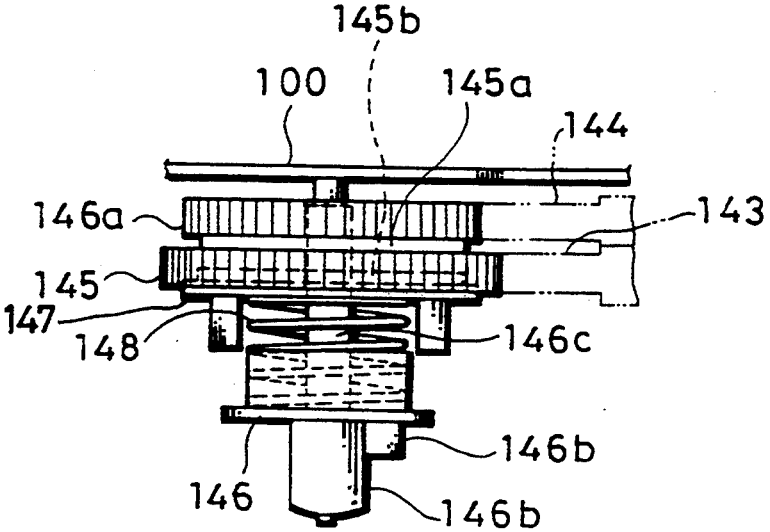
FIG. 16 is a detailed view of the supply reel base.

Supply reel base 146:

FIG. 16 shows the supply reel base 146.

The supply reel base 146 has a torque limiting function and includes a gear 145 with felt pieces 145*a*,145*b* applied to respective opposite surfaces thereof. The gear 145 is rotatable with a pressure plate 147 about a hollow shaft 146*c*. A gear 146*a* and an engaging boss 146*b*, which serves to transfer torques to the supply spool 13 of the ribbon cassette 1, are press-fitted over the shaft 146*c*, so that the gear 146*a*, the engaging boss 146*b*, and the shaft 146*c* are rotatable in unison with each other.

The pressure plate 147 is rotatable in the same direction as the engaging boss 146*b* by engagement between concave and convex portions of the pressure plate 147 and the engaging boss 146*b*. A compression coil spring 148 is disposed between the engaging boss 146*b* and the pressure plate 117 for normally applying forces tending to press the felt piece 145*a* and the pressure plate 147 against each other and also to press the felt piece 145*b* and the gear 146*a* against each other, developing frictional forces therebetween. When the gear 145 is rotated, a torque produced due to the frictional forces is transmitted to the engaging boss 146*b*. When a torque greater than the torque produced due to the frictional forces is generated, since the felt pieces 145*a*, 145*b* slip against the pressure plate 147 and the gear 146*a*, respectively, such a torque cannot be transmitted to the engaging boss 146*b*. The engaging boss 146*b* is fitted in an engaging sleeve 13*a* of the supply spool 13. When the supply spool 13 is angularly positioned to allow a tooth 146*d* of the engaging boss 146*b* to engage in a recess 13*b* in the engaging sleeve 13*a*, the rotation can be transmitted to the supply spool 13.

Rewinding of the ink ribbon (continued):

Through the above operation, the pendulum gear 124 transmits the rotation to the supply reel base 146 to rotate the supply reel base 146 and hence the supply spool 13 for thereby winding (rewinding) the ink ribbon 10 on the supply spool 13. However, the link 149 moves to enable a tip end 149*a* thereof to reduce the range in which the shaft 125*a* of the pendulum arm 125 is movable, until the pendulum gear 124 is brought out of mesh with the gear 145 whereupon the pendulum gear 124 rotates idly. An arrangement for moving the link 149 will be described later on.

Operation of the DC motor for actuating the head mechanism will be described below.

A motor 300 (see FIG. 4) that is rotatable in normal and reverse directions is mounted on a bracket 301, and rotates a gear 305 at a reduced-speed.

Transmission of rotation for movement to a head position:

The rotation of a pinion 300*a* press-fitted over the shaft of the motor 300 is reduced in speed by double gears 302, 303, 304, and transmitted to the gear 305. The gear 305 has a reflecting seal 307 attached thereto and its angular displacement is monitored by two optical sensors 306*a*, 306*b* that operate in association with the reflecting seal 307. The reflecting seal 307 is made of a sheet of aluminum or the like whose surface has a high optical reflectance, and is printed with three black areas 307*a*, 307*b*, 307*c* of a lower optical reflectance. The optical sensors 306*a*, 306*b* detect the black areas 307*a*, 307*b*, 307*c* as dark areas, and the aluminum surface as a bright area.

Figure 19:
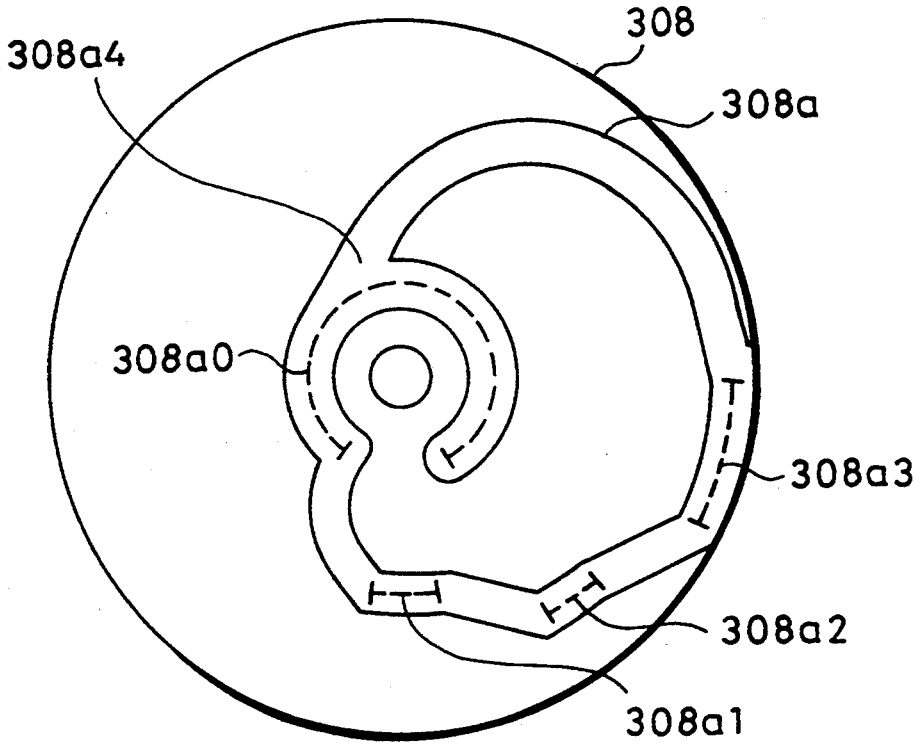
FIG. 19 is a detailed view of the cam groove 308*a*.
Figure 20:
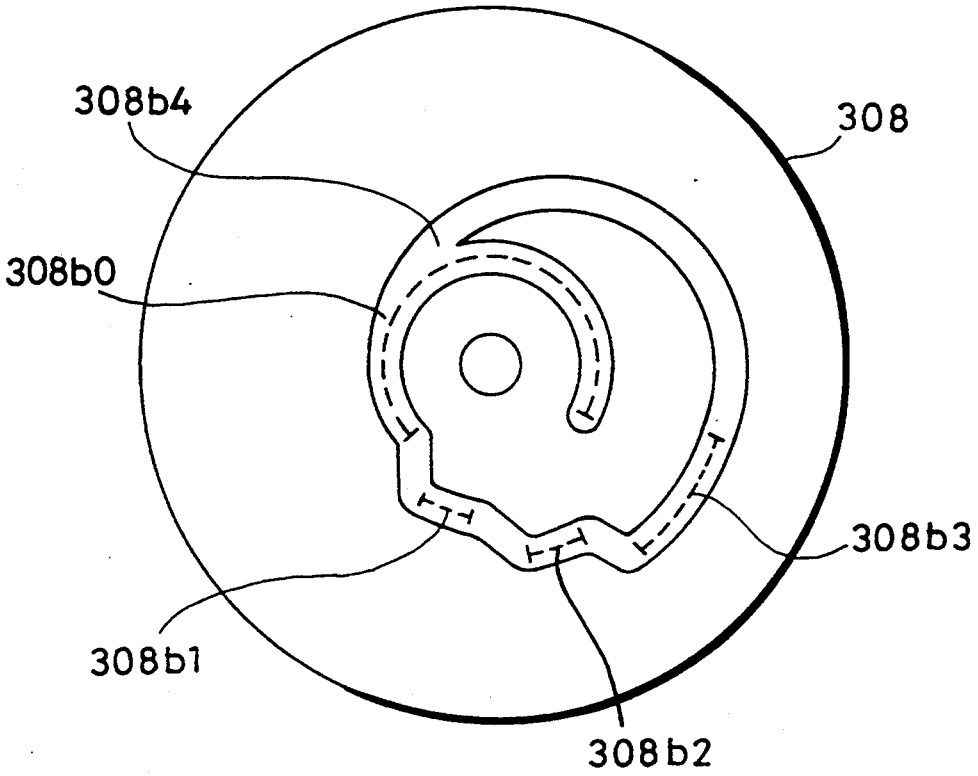
FIG. 20 is a detailed view of the cam groove 308*b*.
Figure 21:
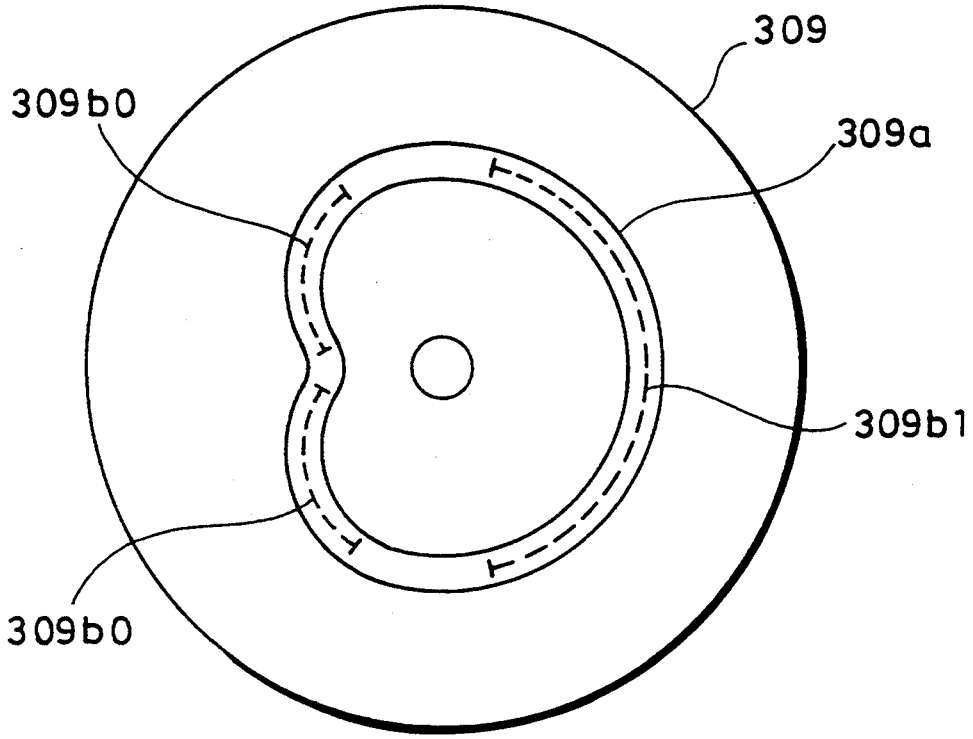
FIG. 21 is a detailed view of the cam groove 309*a*.
Figure 22:
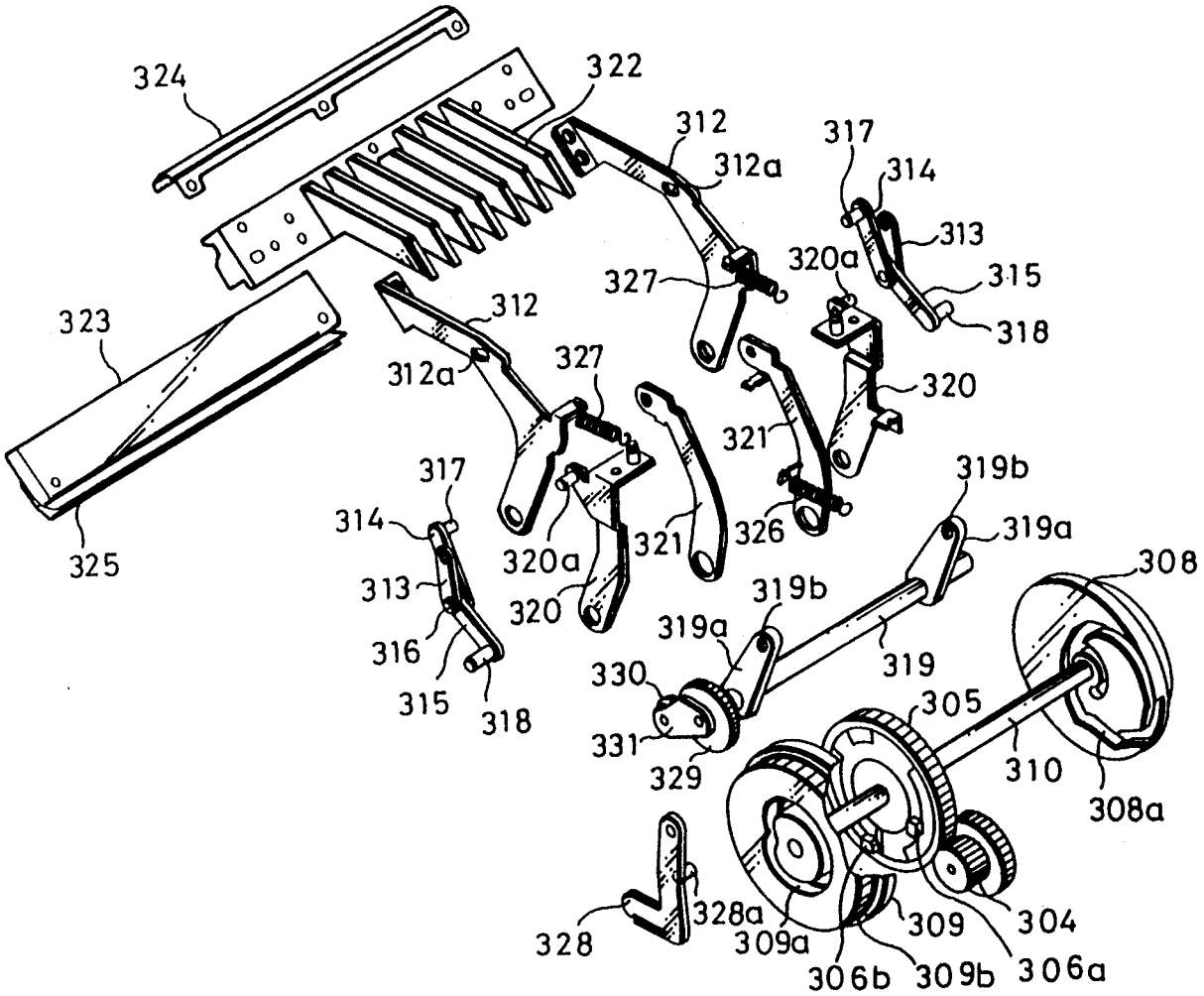
FIG. 22 is an exploded perspective view of a mechanism for actuating head arms.

As shown in FIG. 22, a cam gear 308 (hereinafter referred to as a "cam 308" and a cam gear 309 (hereinafter referred to as a "cam 309" are connected to the gear 305 by a shaft 310. As shown in FIGS. 19 and 20, the cam 308 has a cam groove 308*a* defined in an inner surface thereof for angularly moving one of a pair of head arms 312 (see FIG. 22), and a cam groove 308*b* defined in an outer surface thereof for angularly moving a change arm 142 (see FIG. 5). As shown in FIG. 21, the cam 309 has a cam groove (not shown) defined in an inner surface thereof for angularly moving the other head arm 312, and a cam groove 309*a* defined in an outer surface thereof for angularly moving a cam lever 328. The cam 309 also has a gear 309*b* (see FIG. 22) for transmitting rotation to a double gear 329. The cam groove 308*a* for angularly moving one of the head arms 312 and the non-illustrated cam groove of the cam 309 for angularly moving the other head arm 312 are paired with each other and operate in the same manner. Therefore, only the cam groove 308*a* will be described below.

Head position:

The gear 305 can be stopped in any of five predetermined positions. Angular movement of the gear 305 to these positions and a process of setting these positions will be described below with reference to FIG. 17A. In order to detect a reference position, the gear 305 is rotated clockwise, and stopped when the optical sensors 306*a*, 306*b* detect dark areas, i.e., the black areas 307*a*, 307*b*. This stopped position is referred to as a head position H0*a* (hereinafter simply referred to as "H0*a*"), which is a reference head position.

Movement to head positions for printing:

The gear 305 is rotated clockwise from position H0*a*, and stopped when the optical sensor 306*a* detects a bright area. The stopped position is referred to as H1*a*. Then, the gear 305 is rotated clockwise from position H1*a*, and stopped when the optical sensor 306*a* detects a dark area, i.e., the black area 307*b*. This stopped position is referred to as H2*a*. Then, the gear 305 is rotated clockwise from position H2*a*, and stopped when the optical sensor 306*a* detects a bright area. This stopped position is referred to as H3*a*. Then, the gear 305 is rotated clockwise from position H3*a*, and stopped when the optical sensor 306*a* detects a dark area, i.e., the black area 307*c*. This stopped position is referred to as H4. Thereafter, the gear 305 is rotated counterclockwise from position H4, and after the sensor 306*a* has detected a bright area, the gear 305 is stopped when the optical sensor 306*a* detects a dark area, i.e., the black area 307*b*. This stopped position is referred to as H3*b*. Then, the gear 305 is rotated counterclockwise from position H3*b*, and stopped when the optical sensor 306*a* detects a bright area. This stopped position is referred to as H2*b*. Then, the gear 305 is rotated counterclockwise from position H2*b*, and stopped when the optical sensor 306*a* detects a dark area, i.e., the black area 307*a*. This stopped position is referred to as H1*b*. Then, the gear 305 is rotated counterclockwise from position H1*b*, and stopped when the optical sensor 306*a* detects a bright area. This stopped position is referred to as H0*b*.

Figure 18A:
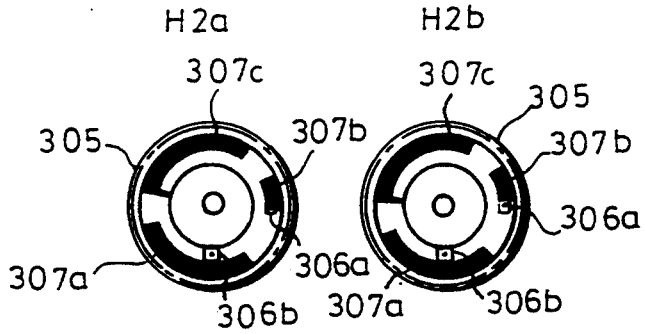
FIGS. 18A, 18B, 18C and 18D are diagrams showing the relationship between stop positions H2*a*, H2*b* of the gear 305 and the angular positions of the cam grooves 308*a*,308*b*, 309*a*.
Figure 18B:
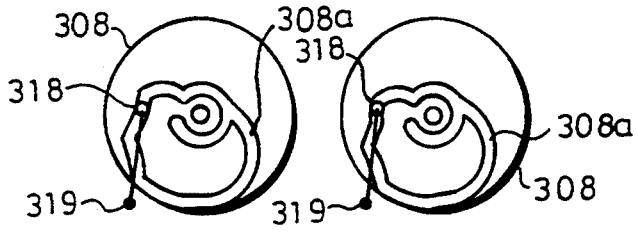
Figure 18C:
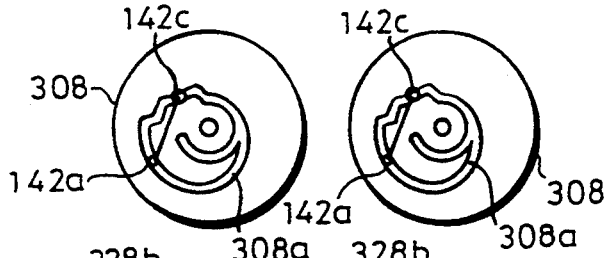
Figure 18D:
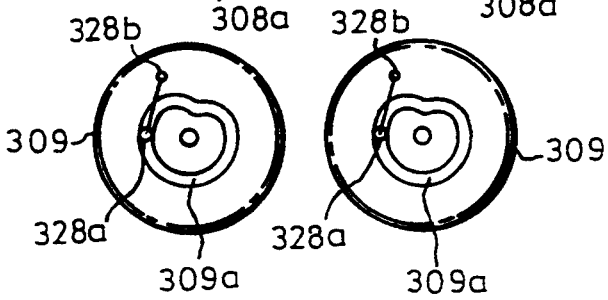

FIG. 18A shows the positional relationship between the gear 305, the optical sensor 306*a*, and the optical sensor 306*b* in the head positions H2*a*, H2*b*. FIG. 18B shows the positional relationship between the cam groove 308*a* and a pin 318 on a link 315 connected to one of the head arms 312. FIG. 18C shows the positional relationship between the cam groove 308*b* and a pin 142*a* on the change arm 142. FIG. 18D shows the positional relationship between the cam groove 309*a* and a pin 328*a* on the cam lever 328.

The motor 300 is de-energized immediately after the head position H2*a* or H2*b* is detected. Therefore, any difference between the positions H2*a*, H2*b* where the gear 305 is stopped is small. Comparison between the positions H2*a*, H2*b* indicates that since the pins are positioned within the same radial profiles on the cams, the relative positions of the pins in the positions H2*a*, H2*b* with respect to the centers of the cams are the same as each other. In the positions H2*a*, H2*b*, since the cam follower 320, the cam lever 328, and the change arm 142 are in the same positions, the positions H2*a*, H2*b* can be regarded as identical to each other in terms of printer control. Therefore, the positions H2*a*, H2*b* will hereinafter be collectively described as a position H2.

Similarly, the pins are stopped in the same radial profiles on the cams in the positions H0*a*, H0*b*, the positions H1*a*, H1*b*, and the positions H3*a*, H3*b*, respectively. Consequently, the positions H0*a*, H0*b*, the positions H1*a*, H1*b*, and the positions H3*a*, H3*b* will hereinafter be collectively described as positions H0, H1, H3, respectively. The position H4 is detected only when the gear 305 is rotated clockwise.

Figures 17A, 17B, 17C, 17D:
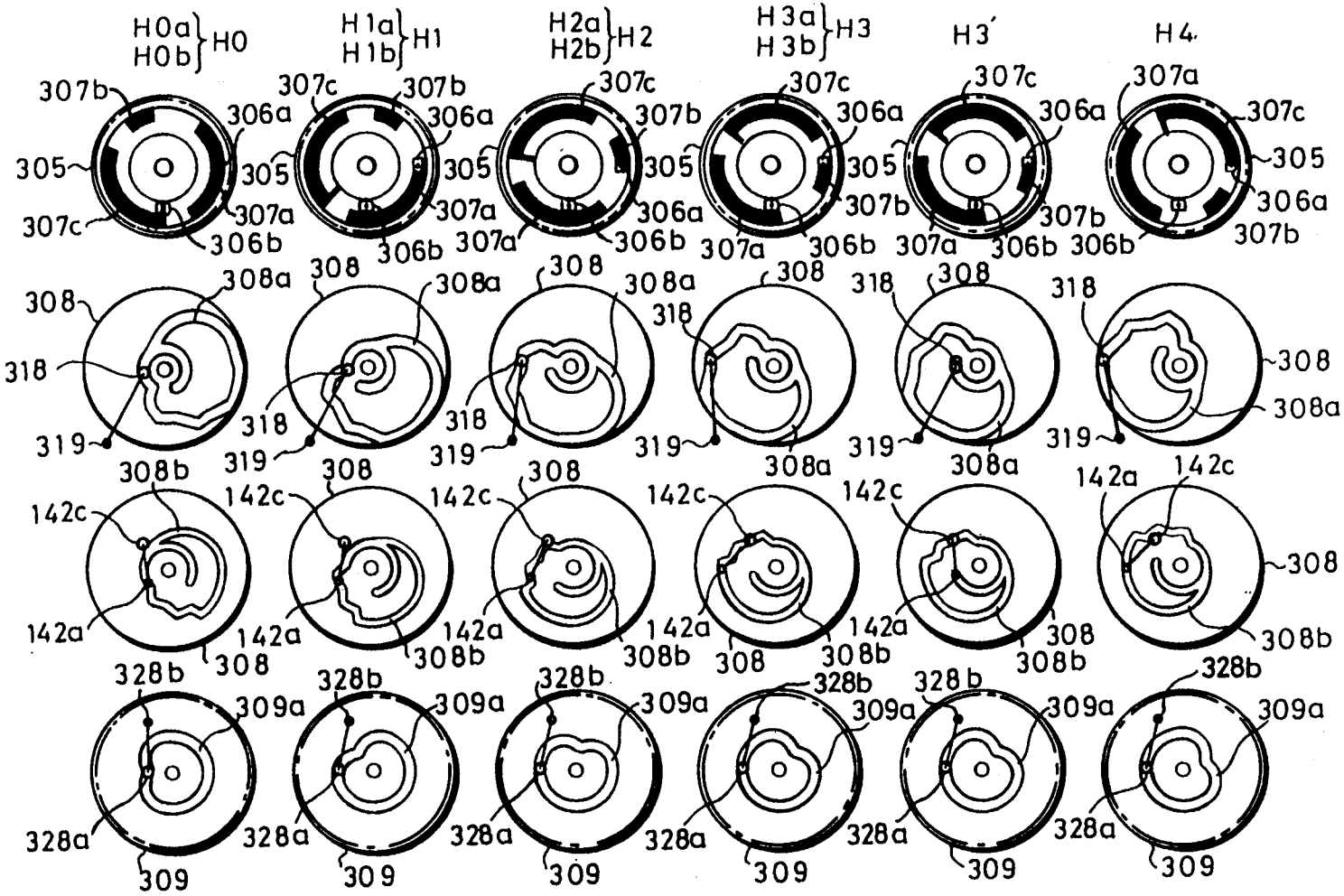
FIGS. 17A, 17B, 17C and 17D are diagrams showing the relationship between stop positions H0–H4 of a gear 305 and angular positions of cam grooves 308*a*, 308*b*, 309*a*.

The positional relationship between the cam groove 308*a* and the pin 318 on the link 315 connected to the head arm 312 in each of the positions H0~H4 of the gear 305 is shown in FIG. 17B. The positional relationship between the cam groove 308*b* and the pin 142*a* on the change arm 142 in each of the positions H0~H4 of the gear 305 is shown in FIG. 17C. The positional relationship between the cam groove 309*a* and the pin 328*a* on the cam lever 328 in each of the positions H0~H4 of the gear 305 is shown in FIG. 17D.

Movement to head positions for reading the ribbon code:

After the reference position HO has been detected, the gear 305 is rotated counterclockwise. After the optical sensor 306*a* has detected the black area 307*a* in the reference position HO, it detects a bright area, then the black area 307*c*, and thereafter the black area 307*b* whereupon the gear 305 is stopped. This stopped position is referred to as H3'. The position H3' is the same as the position H3 insofar as the gear 305 is stopped therein. Since the cam surfaces 308*a*, 308*b* act differently in the position H3' than in the position H3, the position H3' is distinguished from the position H3. After the position H3' has been detected, the gear 305 is rotated clockwise back to the reference position HO.

Operation of the cams 308, 309:

The configurations of the cam grooves 308*a*, 308*b*, 309*a* will be described below with reference to FIGS. 19 through 21.

In FIG. 19, the cam groove 308*a* comprises passages 308*a*0, 308*a*1, 308*a*2, and 308*a*3 lying on circles concentric with the center of rotation of the cam 308, curved passages smoothly interconnecting the passages 308*a*0, 308*a*1, the passages 308*a*1, 308*a*2, and the passages 308*a*2, 308*a*3, respectively, and a curved passage smoothly interconnecting the passage 308*a*3 and an intermediate portion of the passage 308*a*0. The pin 318 on the link 315 is stopped in the passage 308*a*0 when the gear 305 is in the positions HO, H1, H3', in the passage 308*a*1 when the gear 305 is in the position H2, in the passage 308*a*2 when the gear 305 is in the position H3, and in the passage 308*a*3 when the gear 305 is in the position H4.

In FIG. 20, the cam groove 308*b* comprises passages 308*b*0, 308*b*1, 308*b*2, and 308*b*3 lying on circles concentric with the center of rotation of the cam 308, curved passages smoothly interconnecting the passages **308*b*0, 308*b*1, the passages 308*b*1, 308*b*2, and the passages 308*b*2, 308*b*3, respectively, and a curved passage smoothly interconnecting the passage 308*b*3 and an intermediate portion of the passage 308*b*0. The pin 142*a* on the change arm 142 is stopped in the passage 308*b*0 when the gear 305 is in the positions HO, H3', in the passage 308*b*1 when the gear 305 is in the position H1, in the passage 308*b*2 when the gear 305 is in the position H2, and in the passage 308*b*3 when the gear 305** is in the positions H3 and H4.

In FIG. 21, the cam groove **309*a* comprises passages 309*b*0, a passage 309*b*1 lying on a circle concentric with the center of rotation of the cam 309, and curved passages smoothly interconnecting opposite ends of the passages 30960 and 309*b*1. The pin 328*a* on the cam lever 328 is stopped in the passages 309*b*0 when the gear 305 is in the position HO, and in the passages 309*b*1 when the gear 305** is in the positions H1, H2, H3, H3', and H4.

Head positions and operation of the cams: Initial operation:

As the gear 305 rotates in order to detect the reference position 0, the cams 308, 309 rotate clockwise. The passage **308*a*0 of the cam groove 308*a* has a branch point 308*a*4 for branching off toward the passage 308*a*3, and the passage 308*b*0 of the cam groove 308*b* has a branch point 308*b*4 for branching off toward the passage 308*b*3. Upon clockwise rotation, the pins 318, 142*a* do not interfere with the rotation of the cams 308, 309 at these branch points 308*a*4, 308*b*4**.

Structure of head arm 312:

As shown in FIG. 22, the head arms 312 are angularly movably supported on a shaft 319, on which there are angularly movably supported a pair of levers 320 and a pair of arms 321. A pair of fixed plates 311 (see FIG. 3) whose portions are fixed to the top plate 404 is also mounted on the shaft 319. The shaft 319 is supported on the chassis 401. A pair of cam followers **319*a* is fixedly mounted on the shaft 319**.

The levers 320 have respective pins **320*a* coupled to respective links 313 which are coupled to links 314 and the links 315 by pins 316. The links 314 have pins 317 extending through respective slots 312*a* defined in the respective head arms 312. The pins 318 on the links 315 extend through respective holes 319*b* defined in the cam followers 319*a* and engage respectively in the cam groove 308*a* of the cam 308 and the non-illustrated corresponding cam groove of the cam 309. The head arms 312 are positioned between the links 314 and the arms 321 that are coupled to each other by the pins 316. The pins 317 are connected to the respective arms 321 through the slots 312*a* in the head arms 312. The head arms 312 and the arms 321 are normally urged toward each other by springs 327, but their relative angular displacement about the shaft 319 is limited by the pins 317 in the slots 312*a***.

The arms 321 are normally biased by springs 326 in a direction to move the cam followers **319*a* toward the center of the cams 308, 309. A heat sink 322 is attached to the head arms 312. A head 323 and a ribbon guide 324 which doubles as a reflecting mirror are attached to the head sink 322**.

The head 323 has a head cover 325, an array of heating elements (not shown), and a plurality of electric wires (not shown) for supplying electric currents to the heating elements.

Movement of head 323:

Movement of the head 323 will be described below with reference to FIGS. 23A through 23D. The head 323 can be stopped in any of four positions.

Figure 23A:
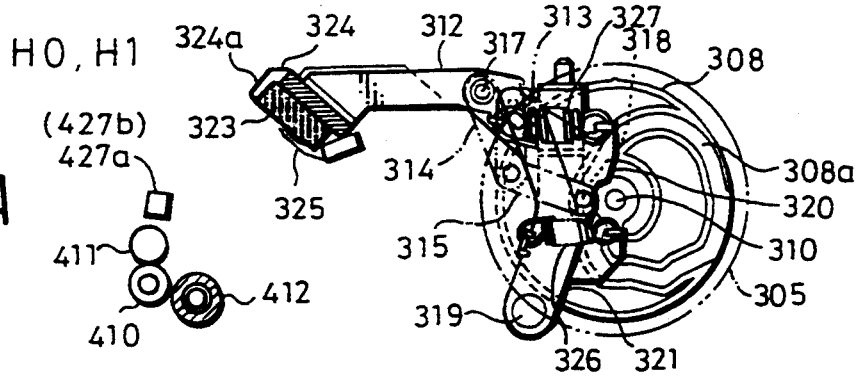
FIGS. 23A, 23B 23C and 23D are diagrams showing the positional relationship between the cam groove 308*a* and a head 323 in respective operating phases.

When the gear 305 is stopped in the positions HO, H1, the head 323 is in a standby position, as shown in FIG. 23A.

Figure 23B:
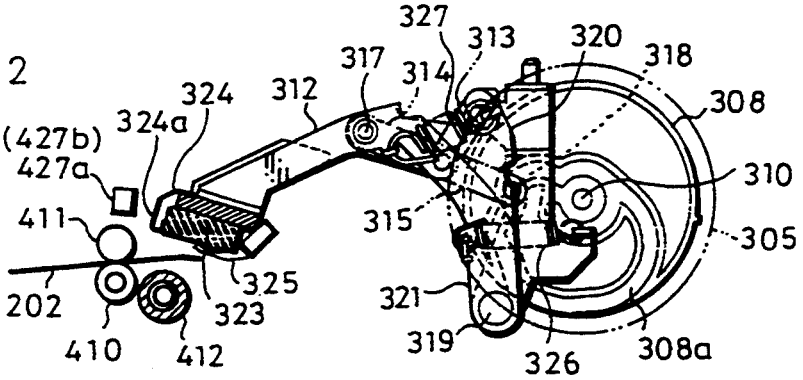

As shown in FIG. 23B, when the gear 305 is angularly moved to the position H2, the head 323 moves a flat surface **324*a* of the ribbon guide 324 to a position in front of optically reflective ribbon mark sensors 427*a*, 427*b* that are mounted on the inlet guide 426 (see FIG. 4**).

A process of detecting the header mark 11 and the patch marks 12 on the ink ribbon 10 will be described below.

The ribbon guide 324 comprises a stainless sheet which is processed into a mirror finish having a high optical reflectance. The header mark 11 and the patch marks 12 on the ink ribbon 10 are in the form of strips having low optical transmittance and reflectance. Since the areas of the ink ribbon 10 other than the header mark 11 and the patch marks 12 have a higher optical transmittance, when the other areas of the ink ribbon 10 are present between the sensors **427*a*, 427*b* and the flat surface 324*a*, the sensors 427*a*, 427*b* detect those ink ribbon areas or the flat surface 324*a* as a bright area, and when the header mark 11 and the patch marks 12 are present between the sensors 427*a*, 427*b* and the flat surface 324*a*, the sensors 427*a*, 427*b*** detect those marks as a dark area.

Inasmuch as the header mark 11 extends as a strip fully across the ink ribbon 10, both the sensors **427*a*, 427*b* can detect the header mark 11 as a dark area. On the other hand, since the patch marks 12 extend as a strip about a half the width of the ink ribbon 10, including the detectable range of the sensor 427*a*, when the sensor 427*a* detects the patch marks 12 as a dark area, the sensor 427*b*** detects the other ink ribbon areas as a bright area.

Figure 23C:
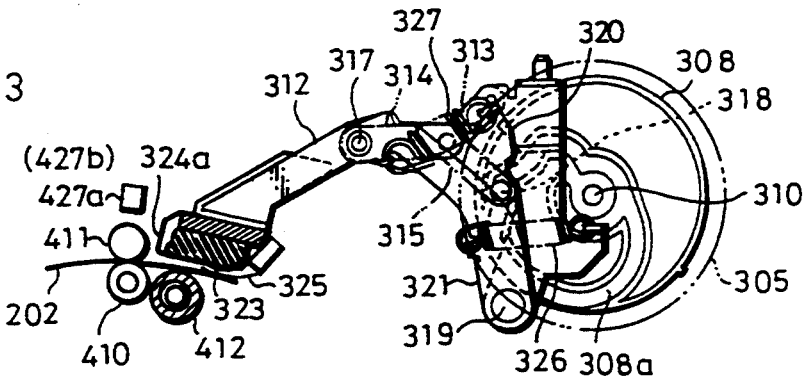

When the gear 305 is angularly moved to the position H3 as shown in FIG. 23C, the head 323 is moved to a position that is spaced from the platen 412 by a small gap. Upon movement of the head 323 to the position H3, the printer changes sheet feed paths as will be described later in detail.

Figure 23D:
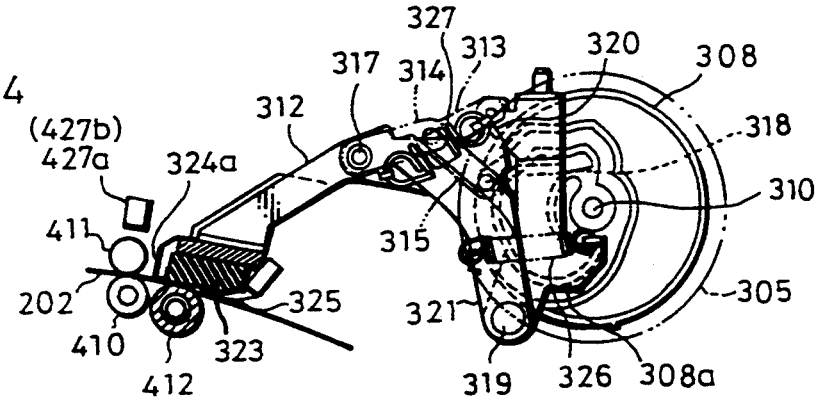

When the gear 305 is angularly moved to the position H4 as shown in FIG. 23D, the head 323 is pressed against the platen 412. The links are moved by the cam 308 to cause the arms 321 to turn the head arms 312 toward the platen 412 until the head 323 is brought into contact with the platen 412. Thereafter, though the arms 321 are turned by the cam 308, since the head arms 312 cannot be turned due to the head 323 already being in contact with the platen 412, the arms 321 and the head arms 312 are angularly moved with respect to each other to release the pins 317 from limited engagement in the slots **321*a* in the head arms 321, whereupon the head arms 312 press the head 323 against the platen 412 under the bias of the springs 327**.

Structure of change arm 142:

The change arm 142 can be angularly moved by the cam groove **308*b*, and can be stopped in any of four positions shown in FIGS. 24A through 24D. The change arm 142 causes a cam groove 142*b* defined therein to actuate a lock finger 143 and a brake finger 144 which are angularly movably supported on the bracket 100 by a pivot shaft 142*c*. The lock finger 143 can engage the gear 146*a* of the supply reel base 146 to prevent the gear 146***a* from rotating, and the brake finger 144 can engage the gear 145 of the supply reel base 146 to prevent the gear 145 from rotating. The change arm 142 can also actuate the link 149 that is coupled thereto by a shaft 149*c*. The link 149 has a slot 149*b* which is guided by the shaft 146*c* of the supply reel base 146. As the link 149 is moved, the tip end 149*a* thereof can bring the pendulum gear 124 into and out of mesh with the gear 145.

Figure 24A:
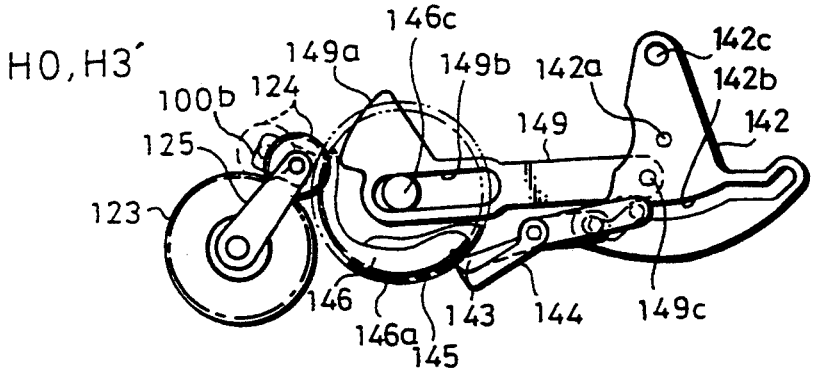
FIGS. 24A, 24B 24C and 24D are diagrams showing the manner in which a change arm operates.

In FIG. 24A, the gear 305 is angularly moved to the positions HO, H3'. In the positions HO, H3', the lock finger 143 engages the gear 146*a*, the brake finger 144 disengages from the gear 145, and the link 149 does not limit movement of the pendulum arm 125.

Figure 24B:
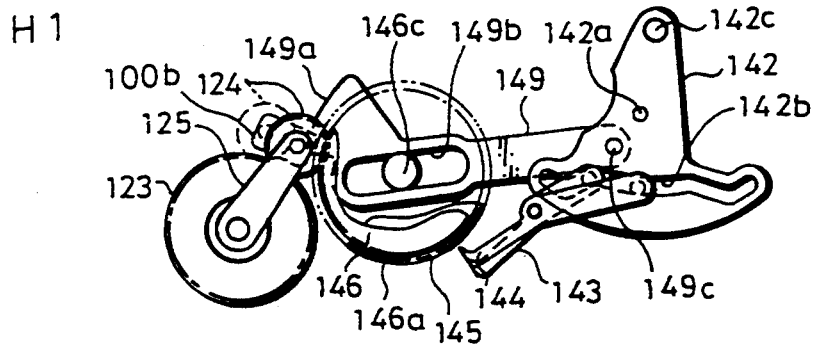

In FIG. 24B, the gear 305 is angularly moved to the position H1. In the position H1, both the lock finger 143 and the brake finger 144 disengage from the respective gears 146*a*, 145, and the link 149 does not limit movement of the pendulum arm 125.

Figure 24C:
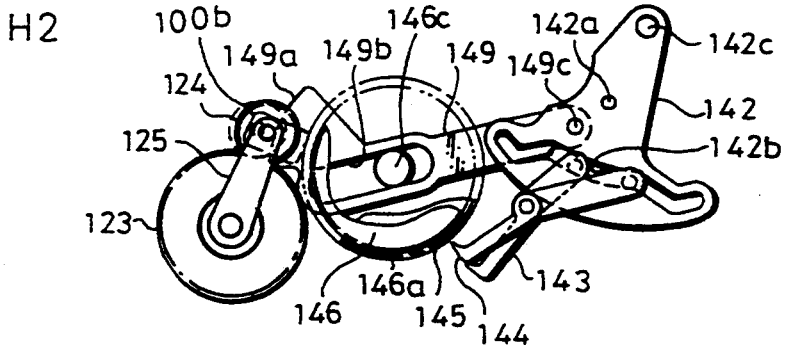

In FIG. 24C, the gear 305 is angularly moved to the position H2. In the position H2, both the lock finger 143 and the brake finger 144 disengage from the respective gears 146*a*, 145, and the link 149 limits movement of the pendulum arm 125.

Figure 24D:
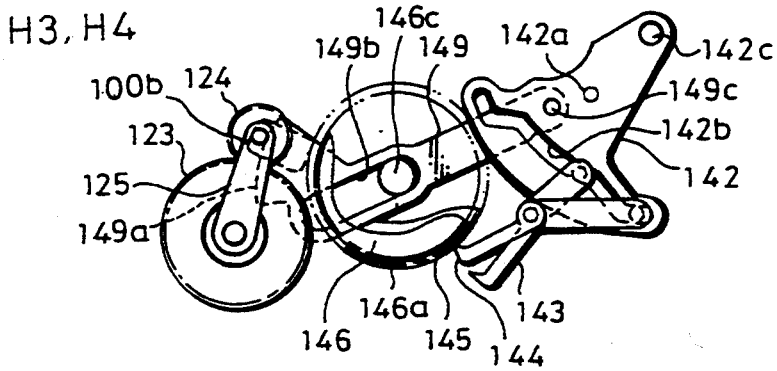

In FIG. 24D, the gear 305 is angularly moved to the positions H3, H4. In the positions H3, H4, the lock finger 143 disengages from the gear 146*a*, the brake finger 144 engages the gear 145, and the link 149 limits movement of the pendulum arm 125.

Figure 25A:
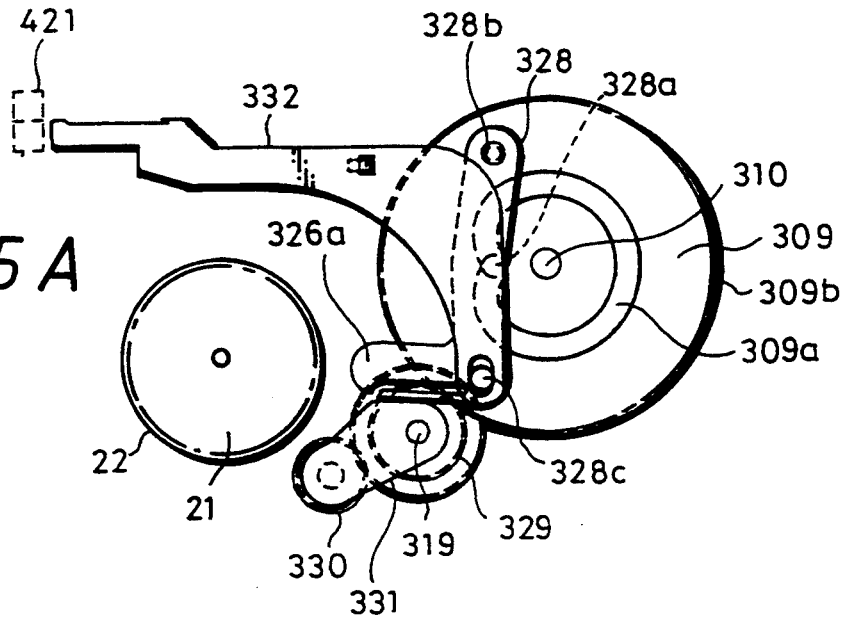
FIGS. 25A and 25B are diagrams showing the manner in which the cam groove 309*a*, a pendulum gear 330, and a lock lever 332 operate.
Figure 25B:
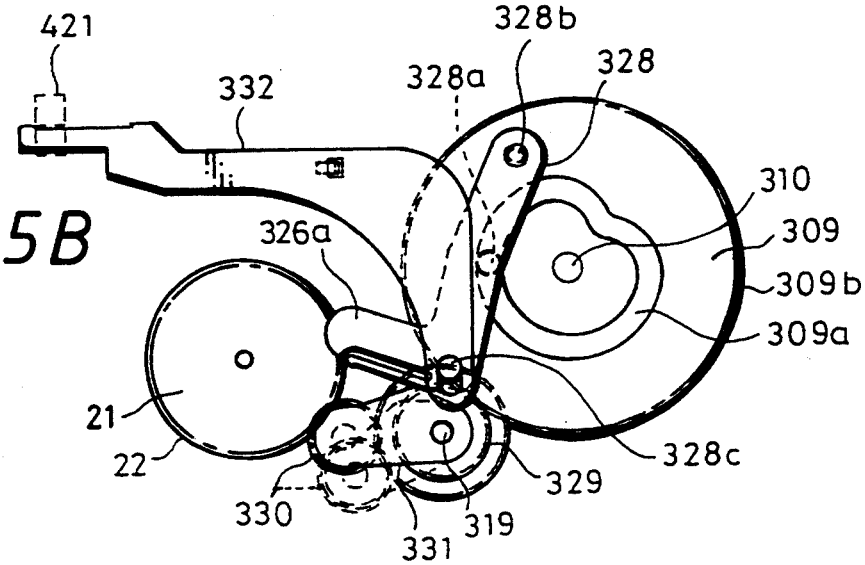

Structure of cam lever 328:

The cam lever 328 can be angularly moved about a pivot shaft 328*b* by the cam groove 309*a*, and can be stopped in any of two positions shown in FIGS. 25A and 25B. The cam lever 328 has a top end 326*a* for limiting movement of a pendulum arm 331. The cam lever 328 can slide the lock lever 332 slidably supported on the ribbon door holder 422 (see FIG. 9) upon movement of the pin 328*a* on the cam lever 328 along the cam groove 309*a*.

Structure of pendulum gear 330:

A pendulum gear 330 is rotatably mounted on the pendulum arm 331, which is held in frictional contact with the pendulum gear 330 under frictional forces developed by a spring (not shown). When the cam 308 rotates clockwise in FIGS. 25A and 25B, the rotation of the cam 308 is transmitted from the gear 309*b* on the cam 309 to a double gear 329 rotatably mounted on an end of the shaft 319. The pendulum arm 331, which is angularly movably supported on the shaft 319, is turned clockwise, bringing the pendulum gear 330 into mesh with the gear 22 of the code ring 21 of the ribbon cassette 1 thereby to rotate the code ring 21.

In FIG. 25A, the gear 305 is in the position HO. The cam lever 328 prevents the pendulum arm 331 from bringing the pendulum gear 330 into mesh with the gear 22. the lock lever 332 is retracted, allowing the ink ribbon door 420 to be opened.

In FIG. 25B, the gear 305 is in the positions H1, H2, H3, H3', H4. The cam lever 328 does not limit the pendulum arm 331, permitting the pendulum gear 330 to mesh with the gear 22. The lock finger 421 is locked by the lock lever 332, making it impossible to open the ink ribbon door 420.

A process of rotating the ribbon code ring 21, which is a central feature of the present invention, will be described below.

After the gear 305 has been brought to the position HO, the gear 305 is rotated clockwise to the position H3', and then rotated counterclockwise back to the position HO. Upon movement from the position H3' to the position H3, the pendulum gear 330 meshes with the gear 22 as shown in FIG. 25B, thus rotating the ribbon code ring 21, and the information mark 23 is read by a sensor 335 (see FIG. 2). When the above clockwise and counterclockwise rotation of the gear 305 is repeated twice, the ribbon code ring 21 makes two revolutions.

Even if one information mark 23 is employed, since the ribbon code ring 21 makes two revolutions, the information mark 23 can always be read once by the sensor 335 irrespective of the position where the header bit of the ribbon code ring 21 is stopped.

During the above operation, since the pins 318 on the head arms 312 move in the passage 308*a*0 of the cam groove 308*a* in the cam 308 and the corresponding passage of the cam groove in the cam 309, the head arms 312 are not moved. Similarly, since the pin 142*a* on the change arm 142 moves in the passage 30860 of the cam groove 308*b*, the change arm 142 is not moved. Therefore, only those parts of the printer which are actuatable by the cam groove 308*b* are moved, and the parts remain stopped. While the information mark 23 is being read, the ink ribbon door 420 is locked against being opened, thus preventing a readout error from occurring in reading the information mark 23 which would otherwise happen if the user opened the ink ribbon door 420 and touched the ribbon cassette 1.

A series of operations of a printing process will be described below also with reference to FIGS. 26 through 31.

Figure 26:
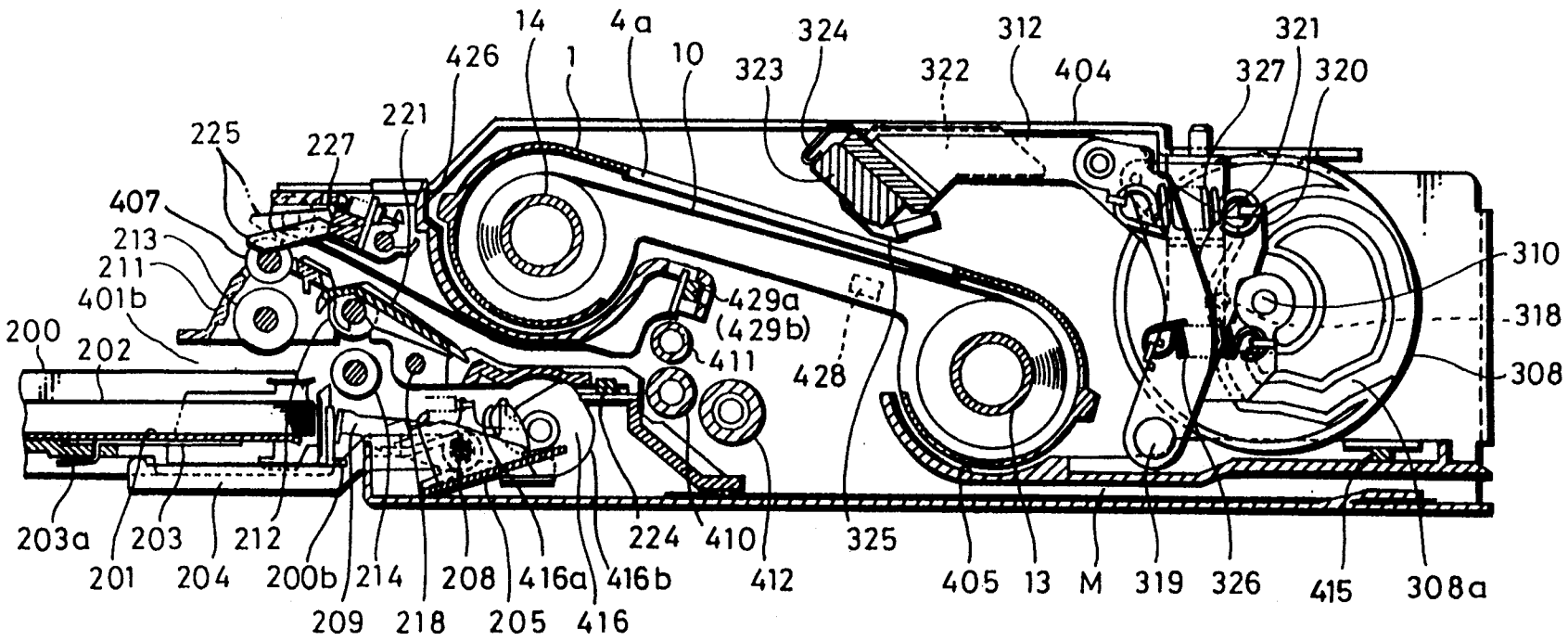
FIG. 26 is a view showing the manner in which the printer operates in a head position HO and a sheet position P0.

Initialization:

When the power supply switch of the printer is turned on, the following initializing operations are carried out:

Sheet position initialization:

It is confirmed that the gear 118 is in the sheet position P0 as shown in FIG. 26. If the gear 118 is not in the sheet position P0, then the motor 101 is energized to turn the gear 118 to the sheet position P0.

Head position initialization:

It is confirmed that the gear 305 is in the head position HO as shown in FIG. 26. If the gear 305 is not in the head position HO, then the motor 300 is energized to turn the gear 305 to the head position HO. If the sheet and head positions P0, HO cannot be confirmed, then the printer is judged as suffering a failure.

Confirmation of ink ribbon 10 and ribbon code readout:

It is confirmed with a switch (not shown) that the ink ribbon door 420 is closed, and it is also confirmed with a switch 428 that the ribbon cassette 1 is loaded. If confirmed, then the motor 300 is reversed to cause the gear 309*b* of the cam 309 to move the double gear 329 and the pendulum gear 330 to rotate the ribbon code ring 21, and the information code 23 is read by the sensor 335 (FIG. 2): If the read information code 23 is not in conformity with any of various information codes that have been stored in the printer, it is determined that there is no ribbon cassette loaded, and a warning is issued.

If the switch (not shown) for detecting the ink ribbon door 420 and the switch 428 for detecting the ribbon cassette 1 are turned on and off while the printer is in a standby condition, then it is determined that the ribbon cassette 1 has been replaced, and the information code 23 is read again.

Printing operation:

A printing operation is started as when a switch is pressed.

Confirmation of sheet feed tray 200 and print sheet:

It is confirmed with a switch 429 (see FIG. 3) that the sheet feed tray 200 is installed, and it is also confirmed with sensors 430*a*, 430*b* that there is a print sheet 202 in the sheet feed tray 200. If not confirmed, it is determined that no print sheet is loaded, and a warning is issued.

Figure 27:
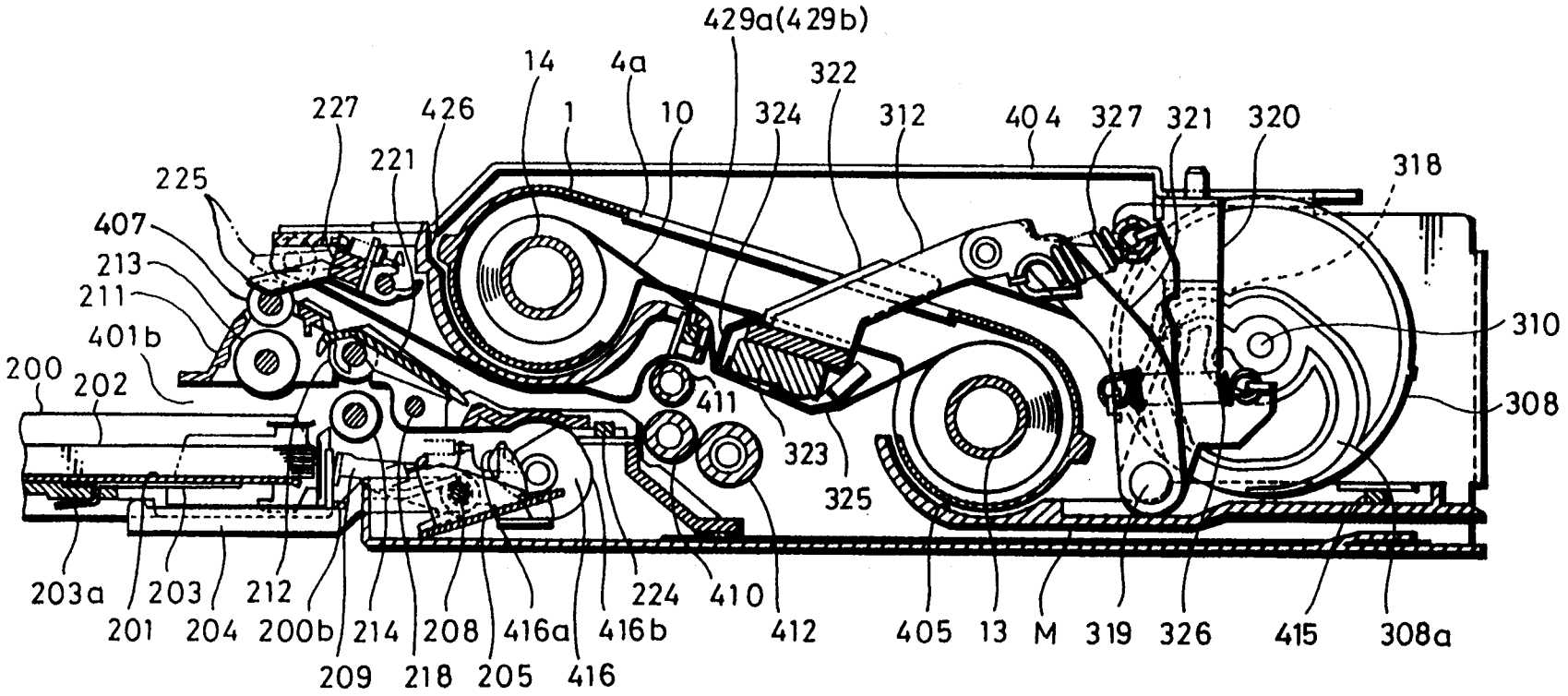
FIG. 27 is a view showing the manner in which the printer operates in a head position H2 and the sheet position P0.

Bringing ink ribbon head into operative position and movement toward head position:

The gear 305 is rotated from the head position HO shown in FIG. 26 into the head position H2 shown in FIG. 27. Until the sensors 427*a*, 427*b* detect the header mark 11 of the ink ribbon 10, the motor 101 is energized to rotate the takeup reel base 111 to wind the ink ribbon 10 for thereby bringing the head of the ink ribbon 10 into an operative position. The motor 101 is continuously energized for a preset period of time. If the header mark 11 is not detected even when the motor 101 is continuously energized for the preset period of time, then it is determined that no remaining length of ink ribbon is available, and a warning is issued.

Figure 28:
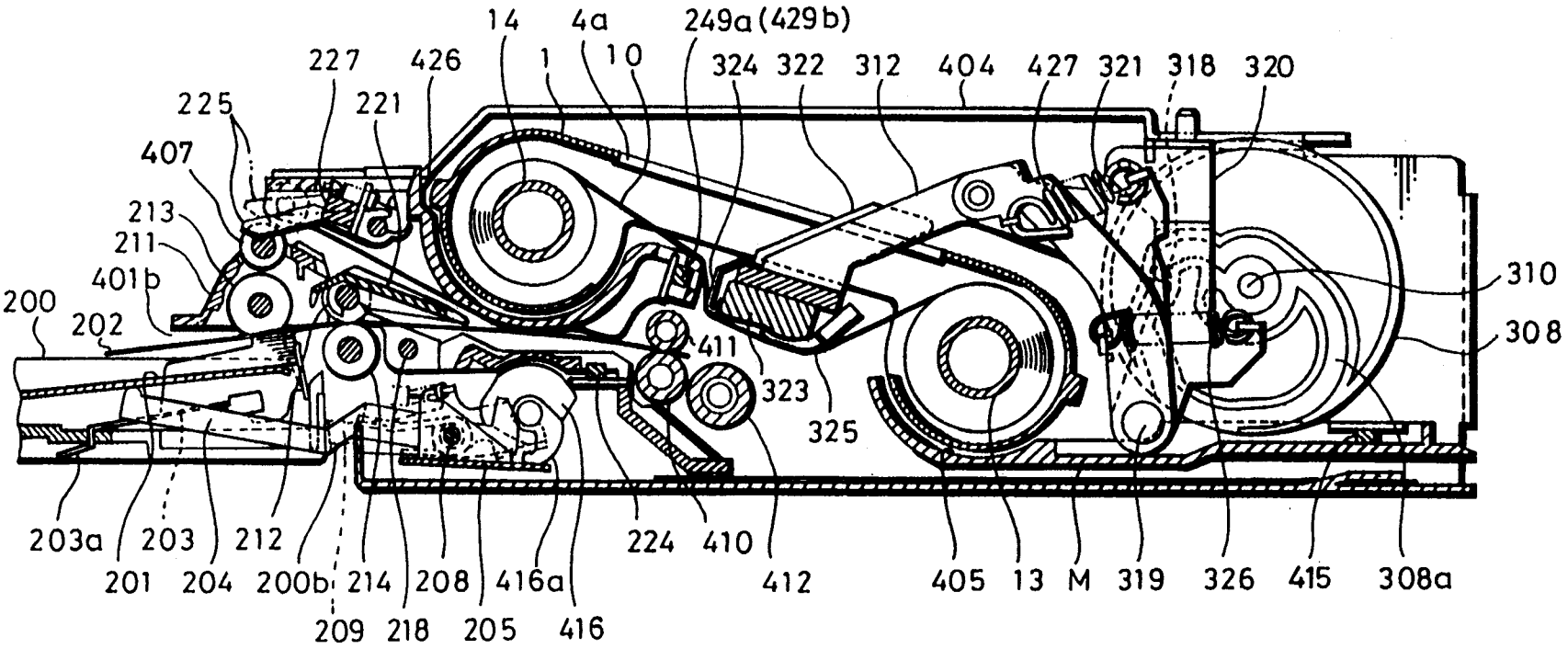
FIG. 28 is a view showing the manner in which the printer operates in the head position H2 and a sheet position P1.

Movement to sheet position:

The motor 101 is energized to rotate the gear 118 from the sheet position P0 to the sheet position P1 shown in FIG. 28. Specifically, the gear 118 is rotated counterclockwise by the motor 101 to turn the sheet feed cam 416 for thereby causing the pressing plate 205 to lift the sheet feed arm 204. A print sheet 202 is elevated into abutment against the sheet feed roller 213. At this time, the lock finger 209 is released from the cam surface 416*b* and engages in the hole 200*a* in the sheet feed tray 200, thus locking the sheet feed tray 200. Simultaneously, respective cam surfaces 417*b* of the release cam 417 cause the pinch roller arms 413 to move the pinch roller 411 away from the capstan 410.

Upon rotation of the gear 118, respective cam surfaces 417*a* of the release cams 417 turn the release lever 222, causing the turn plate 215 to bring the separating roller 214 into abutment against the sheet feed roller 212. At this time, the release lever 222 is turned to open the shutter 221.

The print sheet 202 is now drawn in by the sheet feed roller 213, gripped between the sheet feed roller 212 and the separating roller 214, and delivered through the open shutter 221 into the printer. While the print sheet 202 is being fed under this condition, since the pinch roller arms 413 are released from the cam surfaces 417*b* of the release cams 417, the pinch roller 411 is held in pressed contact with the capstan 410 under the bias of the spring 414.

Figure 3:
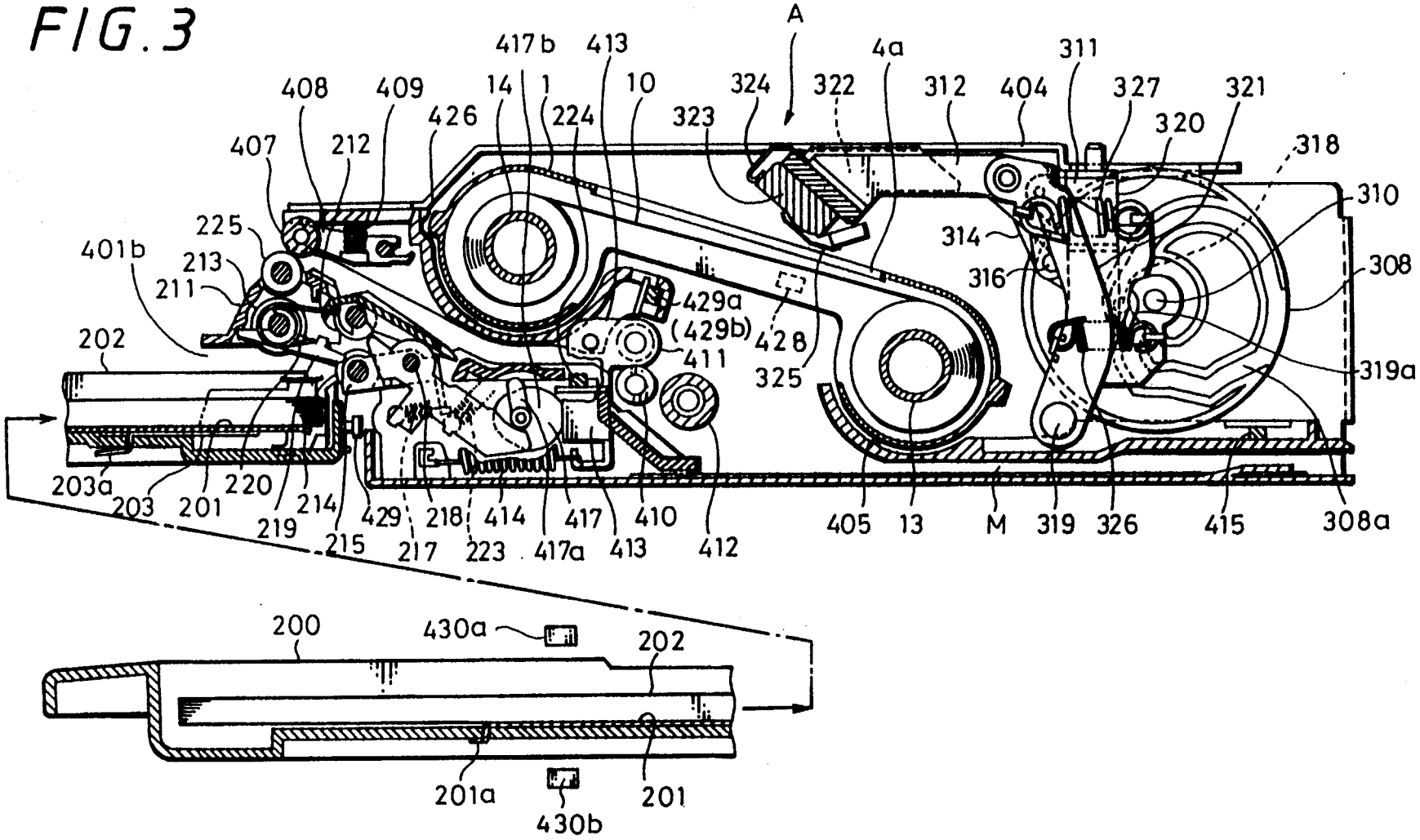
FIG. 3 is a cross-sectional view of the printer, taken along a plane across a cam 308.

Feeding of print sheet and detection by sheet feed sensor 224:

The stepping motor 102 is energized to feed the print sheet 202 until it is detected by a sheet feed sensor 224 (see FIGS. 3 and 4). If no print sheet is detected by the sheet feed sensor 224 after the stepping motor 102 has been energized for a predetermined interval, then the printer is judged as suffering a sheet feed error, and a warning is issued.

Movement to sheet position:

When the print sheet 202 is fed for a predetermined interval from a reference position in which the leading end of the print sheet 202 is detected by the sheet feed sensor 224, the print sheet 202 is gripped between the capstan 410 and the pinch roller 411. Thereafter, the motor 101 is energized to rotate the gear 118 from the sheet position P1 shown in FIG. 28 to the sheet position P2 shown in FIG. 29.

Dropping of print sheet and movement to head position:

When the print sheet 202 is fed for a predetermined interval from the reference position in which the leading end of the print sheet 202 is detected by the sheet feed sensor 224, the leading end of the print sheet 202 is positioned beneath the head cover 325. While the leading end of the print sheet 202 is being positioned beneath the head cover 325, the motor 300 is energized to rotate the gear 305 from the position H2 shown in FIGS. 23B, 28 to the position H3 shown in FIGS. 23C, 29. The leading end of the print sheet 202 which has been directed substantially toward the center of the supply reel base 146 is pressed by the head cover 325 and changes its direction of movement toward a passage M defined between the chassis 401 and a guide 406. Further delivery of the print sheet 202 leads the leading end thereof into the passage M.

Detection by sensor 415:

When the print sheet 202 is further fed along, the leading end thereof is detected by a sensor 415. If the leading end of the print sheet 202 is not detected by the sensor 415 after the print sheet 202 has been fed for a predetermined interval from the sheet feed sensor 224, then the printer is judged as suffering a sheet feed error, and a warning is issued.

Detection of print sheet trailing end by sheet feed sensor 224:

When the print sheet 202 is further fed along, the trailing end thereof is detected by the sensor 224. The length of the print sheet in the direction in which it is fed is determined from the number of steps that the stepping motor 102 is energized after the leading end of the print sheet 202 is detected by the sheet feed sensor 224 until the trailing end of the print sheet 202 is detected by the sheet feed sensor 224. The type of the print sheet 202 is identified by comparing the detected length of the print sheet 202 with the lengths of print sheets depending on predetermined types of print sheets. If the print sheet 202 is not of a predetermined type, or the detected type of the print sheet 202 disagrees with the type of the ink ribbon as identified from the information code 23 on the ribbon cassette 1, then a warning is issued.

Inching of print sheet:

After the trailing end of the print sheet 202 is detected by the sheet feed sensor 224, the print sheet 202 is fed by 3 millimeters for detection by the sheet feed sensor 224. If any print sheet end is detected again by the sheet feed sensor 224, then the previous detection by the sheet feed sensor 224 is determined as being caused by a printed image or a stain on the reverse side of the print sheet 202, and the second detected print sheet end is regarded as a true trailing end of the print sheet 202.

Movement of print sheet toward print position:

By feeding the print sheet 202 a predetermined distance (few millimeters) from the position in which the trailing end of the print sheet 202 is detected by the sheet feed sensor 224, the print sheet 202 is moved to a print position, in which the print sheet 202 is stopped.

Figure 29:
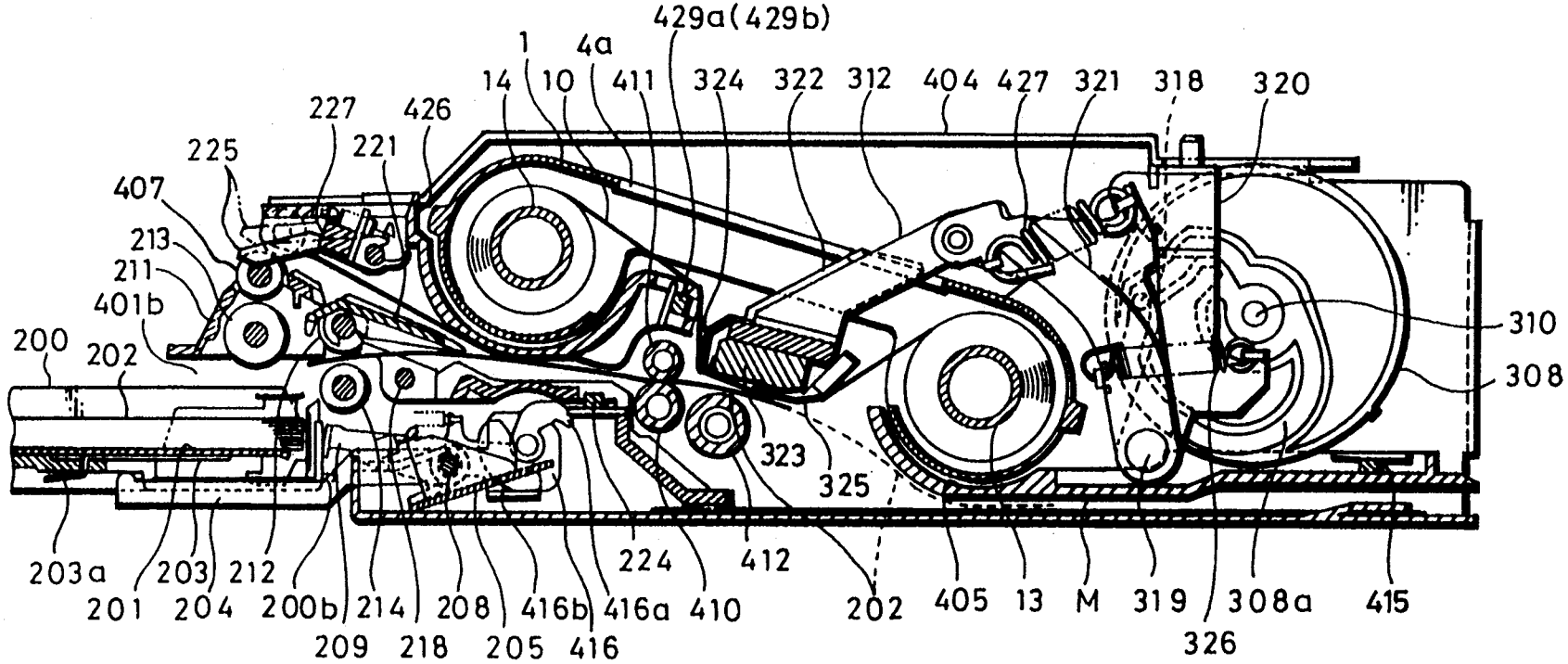
FIG. 29 is a view showing the manner in which the printer operates in a head position H3 and a sheet position P2.
Figure 30:
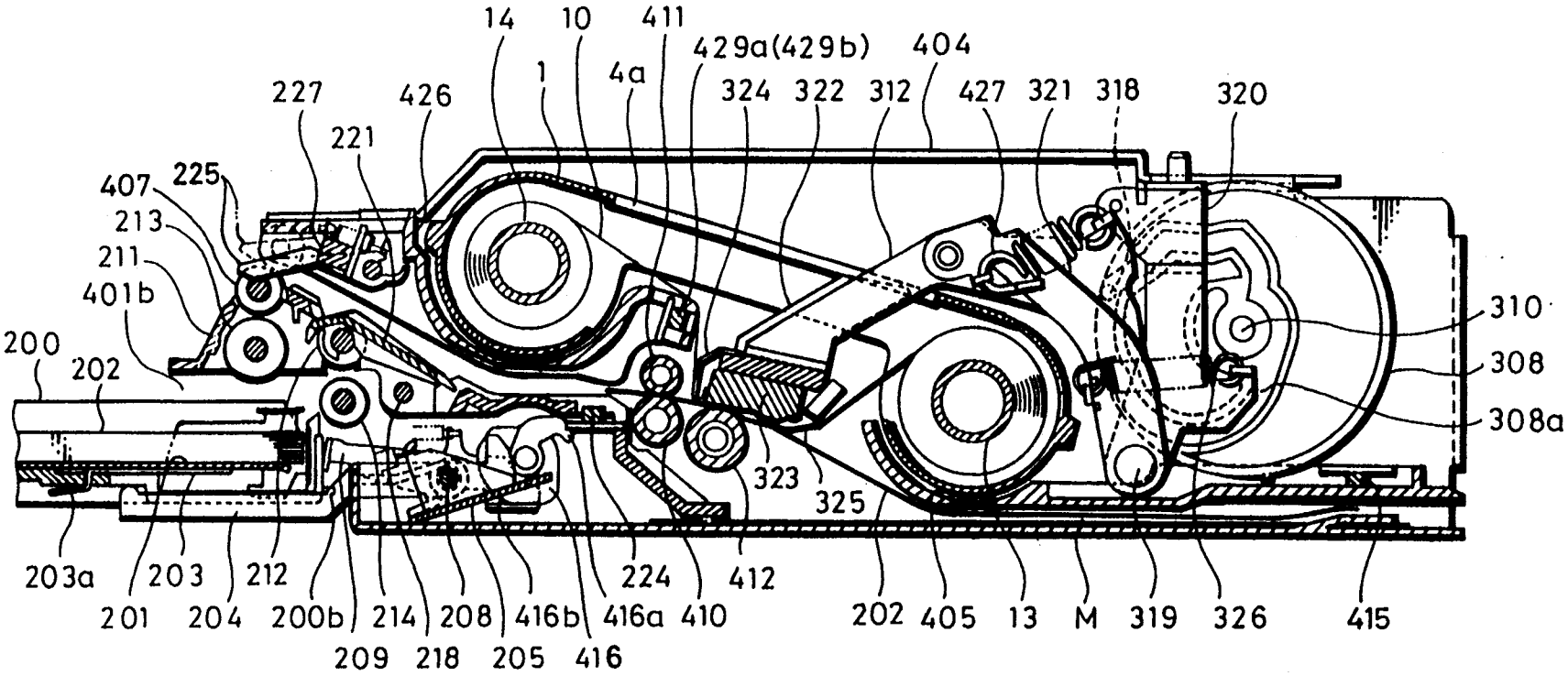
FIG. 30 is a view showing the manner in which the printer operates in a head position H4 and the sheet position P2.

Movement of head position:

The motor 300 is energized to rotate the gear 305 from the position H3 shown in FIGS. 23C, 29 to the position H4 shown in FIGS. 23D, 30 to press the head 323 against the platen 412.

Printing:

The motor 101 is energized to rotate the takeup reel base 111 to wind the ink ribbon 10. At the same time, the stepping motor 102 is reversed to reverse the capstan 410 to feed back the print sheet 202, during which time the print sheet 202 is printed by the head 323.

Figure 31:
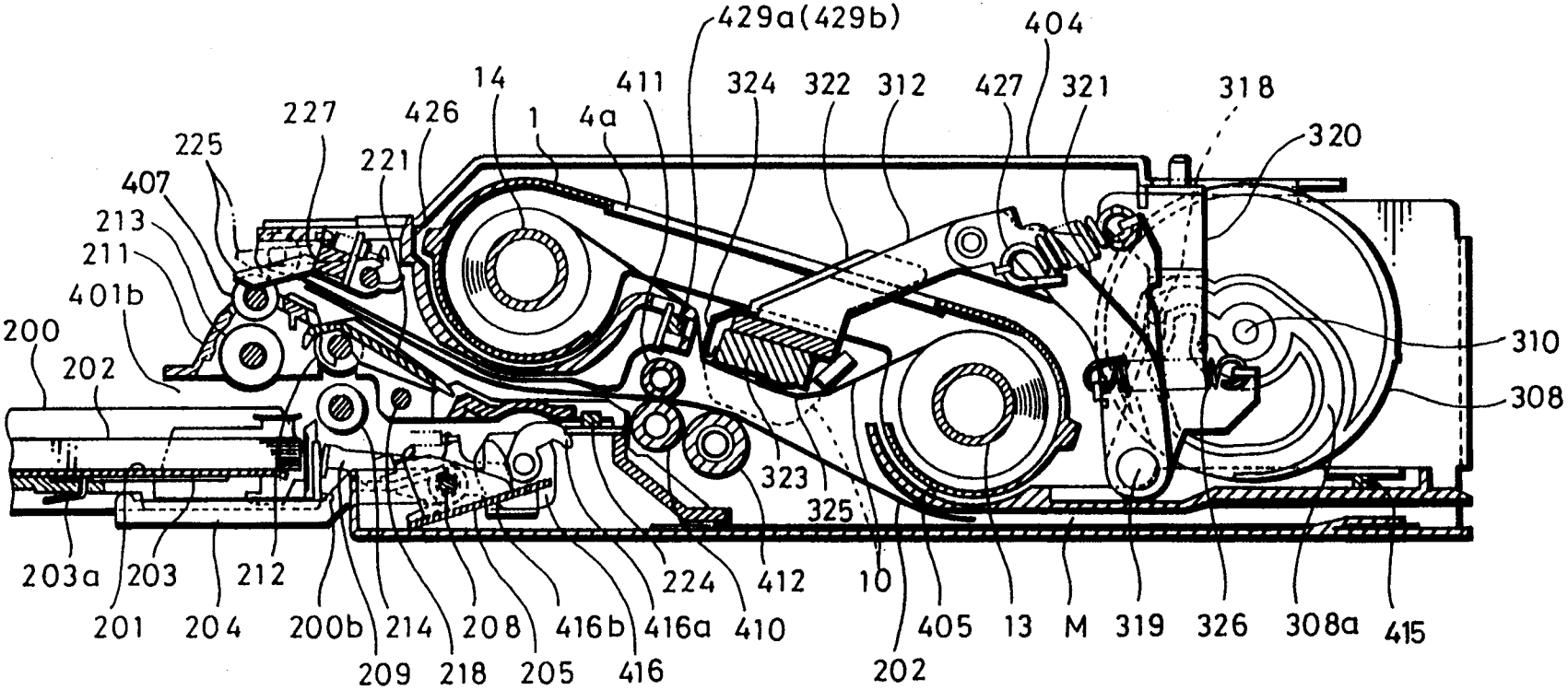
FIG. 31 is a view showing the manner in which the printer operates in the head position H2 and the sheet position P2.

Movement of head position and removal of slack from ink ribbon:

The motor 300 is energized the rotate the gear 305 from the position H4 shown in FIGS. 23D, 30 to the position H2 shown in FIGS. 23B, 31. The motor 102 is reversed for a preset period of time to cause the pinion 121 and the double gear 122 to rotate the gear pulley 123 clockwise (see FIG. 24B), whereupon the pendulum gear 124 swings clockwise into mesh with the gear 145 of the supply reel base 146. At this time, since the pin 142*a* on the change arm 142 is positioned in the cam groove 308*b* of the cam 308 in the position H1 shown in FIG. 17C, the lock finger 143 and the brake finger 144 coupled to the change arm 142 are released from the gear 145 and the gear 146*a*, respectively, thus freeing the supply reel base 146. Therefore, the supply reel base 146 can be rotated in a ribbon rewinding direction by the pendulum gear 124 to remove a slack from, i.e., tighten, the ink ribbon 10.

Bringing ink ribbon head into operative position and movement toward head position:

For a next printing operation, the motor 101 is energized until the sensors 427*a*, 427*b* detect a patch mark 12 on the ink ribbon 10, thus rotating the takeup reel base 111 in a ribbon winding direction to bring the head of the ink ribbon 10 into an operative position. The motor 101 is continuously energized for a preset period of time. If a patch mark 12 is not detected even when the motor 101 is continuously energized for the preset period of time, then it is determined that no remaining length of ink ribbon is available or a ribbon breakage occurs, and a warning is issued.

Dropping of print sheet and movement to head position:

As with the previous dropping of the print sheet 202, when the print sheet 202 is fed for a predetermined interval from the reference position in which the leading end of the print sheet 202 is detected by the sheet feed sensor 224, the leading end of the print sheet 202 is positioned beneath the head cover 325. While the leading end of the print sheet 202 is being positioned beneath the head cover 325, the motor 300 is energized to rotate the gear 305 from the position H2 shown in FIGS. 23B, 28 to the position H3 shown in FIGS. 23C, 29. The leading end of the print sheet 202 is now dropped into the passage M.

If a colored image is to be printed on the print sheet 202, then since three primary color images are printed on the print sheet 202 and the printed surface thereof is finally coated, the above printing operation is repeated four times.

Movement of head position and removal of slack from ink ribbon:

The motor 300 is energized the rotate the gear 305 from the position H4 shown in FIGS. 23D, 30 to the position H2 shown in FIGS. 23B, 31. As with the above ribbon slack removal operation, the motor 101 is reversed for a preset period of time to cause the pendulum gear 124 to mesh with the gear 145 of the supply reel base 146. The supply reel base 146 can be rotated in the ribbon rewinding direction by the pendulum gear 124 to remove a slack from the ink ribbon 10.

Discharge of printed print sheet:

After the print sheet 202 has been printed, the stepping motor 102 is reversed to rotate the capstan 410 and the sheet discharge roller 225 for thereby discharging the print sheet 202 through a sheet discharge passage MO out of the print sheet discharge slot 703 (see FIG. 1). If a sheet discharge sensor 227 detects the presence of a print sheet after the print sheet 202 has been discharged for a predetermined interval, then it is determined that the printer has undergone a sheet discharge failure, and a warning is issued.

With the printer according to the present invention, as described above, when the information code 23 of the ink ribbon 10 is to be read, the print head 323 is held in the initial position HO, and the pendulum gear 330, which can be rotated by the gear 309*b* of the cam 309 only when the motor 300 is reversed, is brought into mesh with the ribbon code ring 21, and the information code 23 on the ribbon code ring 21 which rotates irrespective of the supply spool 13 of the ribbon cassette 1 is detected by the sensor 335. Therefore, when the information code 23 is read, the ink ribbon is not wound, and no wasteful length is required for the ink ribbon format.

When the information code 23 is read, the ribbon code ring is rotated by at least two revolutions. Therefore, regardless of the position of the header bit of the information code 23, the information code 23 can be read at least once. As a result, the information code 23 can be read with improved reliability.

When the information code 23 is read, the print head 323 remains stopped in the initial position HO. Thus, the print head 323 is not operated, and hence the ink ribbon 10 is not loosened by being pressed by the print head 323. Accordingly, no slack is required to be removed from the ink ribbon 10 while reading the information code 23.

The ribbon code ring 21 is rotated by the motor 300 and the cam 308 which operate to move the print head 323. Consequently, no dedicated motor is necessary for rotating the ribbon code ring 21, so that the space in the printer may be reduced and the cost of the printer may be lowered.

The present invention is not limited to the exact embodiment which has been described and illustrated. It is contemplated that various changes and modifications may be made in the embodiment without departing from the scope of the invention.

What we claim is:

1. A printer comprising:

a ribbon cassette;

a ribbon code ring rotatably mounted on said ribbon cassette, said ribbon code ring having an information mark formed thereon;

a sensor for reading said information mark;

a first cam gear for moving a print head between a plurality of predetermined positions when rotated in a first direction; and rotation transmitting means operably connected to said first cam gear for rotating said ribbon code ring when said first cam gear is rotated in a second direction opposite to said first direction;

said rotation transmitting means comprising a pendulum gear operable to engage the ribbon code ring only when the first cam gear rotates in said second direction; and further comprising a second cam gear connected to said first cam gear for rotation therewith, and a cam lever operably engaged with said second cam gear, wherein said cam lever prevents the pendulum gear from engaging the ribbon code ring when the second cam gear is in a predetermined rotational position.

2. The printer according to claim 1, further comprising an ink ribbon door for inserting and removing an ink ribbon cassette from said printer, and a lock lever for locking said ink ribbon door in a closed position.

3. The printer according to claim 2, wherein said lock lever is movable by said second cam gear to unlock said ink ribbon door when said second cam gear is in said predetermined rotational position.

4. A printer comprising:

a ribbon cassette;

a ribbon code ring rotatably mounted on said ribbon cassette, said ribbon code ring having an information mark formed thereon;

a sensor for reading said information mark;

a first cam gear for moving a print head between a plurality of predetermined positions when rotated in a first direction;

rotation transmitting means operably connected to said first cam gear for rotating said ribbon code ring when said first cam gear is rotated in a second direction opposite to said first direction;

an ink ribbon door for inserting and removing an ink ribbon cassette from said printer, and a lock lever for locking said ink ribbon door in a closed position; and means for moving said lock lever between a locked and an unlocked position, said means for moving said lock lever preventing said rotation transmitting means from rotating said ribbon code ring when said lock lever is in said unlocked position.

5. The printer according to claim 4, wherein said rotation transmitting means comprises a pendulum gear operable to engage the ribbon code ring only when the first cam gear rotates in said second direction.

6. The printer according to claim 5, wherein said means for moving said lock lever prevents said pendulum gear from engaging the ribbon code ring when said lock lever is in said unlocked position.

7. A printer apparatus comprising:

a cassette holder for receiving a ribbon cassette having a ribbon code ring rotatably mounted on an ink ribbon takeup shaft of the ribbon cassette;

a ribbon door for opening and closing said cassette holder;

a lock finger for securing said ribbon door in a closed position;

a lock lever for locking the movement of said lock finger;

means for releasing the locking of said lock lever when said printing apparatus is not printing; and a gear means for rotating said ribbon code ring, said gear means being connected to a cam lever and being moved by said cam lever when said releasing means is operated;

said gear means comprising a pendulum gear, said pendulum gear being movable into and out of engagement with said ribbon code ring corresponding to the movement of said lock lever; and an arm means of said cam lever being connected to said pendulum gear for selectively preventing engagement between said ribbon code ring and said pendulum gear.

8. A printer apparatus comprising:

a cassette holder for receiving a ribbon cassette having a ribbon code ring rotatably mounted on an ink ribbon takeup shaft of the ribbon cassette;

a ribbon door for opening and closing said cassette holder;

a lock finger for securing said ribbon door in a closed position;

a lock lever for locking the movement of said lock finger;

means for releasing the locking of said lock lever when said printing apparatus is not printing; and a gear means for rotating said ribbon code ring, said gear means being connected to a cam lever and being moved by said cam lever when said releasing means is operated;

said gear means comprising a pendulum gear, said pendulum gear being movable into and out of engagement with said ribbon code ring corresponding to the movement of said lock lever; and said pendulum gear being movable into engagement with said ribbon code ring only when said lock lever is locking the movement of said lock finger.

9. A method for identifying an ink ribbon cassette in a printer, comprising the steps of:

rotating a first cam gear which is drivingly connected to a pendulum gear in a first direction;

swinging said pendulum gear into engagement with a ribbon code ring on the ink ribbon cassette upon said rotation of said first cam gear in said first direction;

rotating said pendulum gear while engaged with said ribbon code ring to cause said ribbon code ring to rotate a predetermined amount;

reading an information mark on said ribbon code ring while said ribbon code ring is rotated a predetermined amount;

locking a ribbon door of the printer to prevent the ribbon door from opening while said pendulum gear is engaged with said ribbon code ring;

controlling the locking of the ribbon door based on the rotational position of said first cam gear;

rotating said first cam gear in a second direction opposite to said first direction to swing said pendulum gear out of engagement with said ribbon code ring after the reading of said information mark; and controlling a printing head position with a second cam gear operatively connected to said first cam gear for rotation therewith.

10. The method of claim 9, wherein the step of controlling the printing head position comprises rotating said second cam gear in said second direction between a plurality of predetermined positions corresponding to predetermined positions of said printing head.

11. The method of claim 10, further comprising the step of maintaining said printing head in a stationary position while rotating said first and second cam gears in said first direction.

* * * * *